US007945184B2

(12) United States Patent
Takagi

(10) Patent No.: US 7,945,184 B2
(45) Date of Patent: May 17, 2011

(54) PROCESS CARTRIDGE WITH MEMBER FOR ELECTRICAL CONNECTION TO IMAGE-FORMING DEVICE

(75) Inventor: Takeyuki Takagi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 16 days.

(21) Appl. No.: 11/442,291

(22) Filed: May 30, 2006

(65) Prior Publication Data

US 2006/0269313 A1 Nov. 30, 2006

(30) Foreign Application Priority Data

May 30, 2005 (JP) ..... P2005-157780
Jun. 14, 2005 (JP) ..... P2005-173958

(51) Int. Cl.
*G03G 15/00* (2006.01)

(52) U.S. Cl. ..... 399/90; 399/111

(58) Field of Classification Search ..... 399/90, 399/111, 119, 113, 71
See application file for complete search history.

(56) References Cited

U.S. PATENT DOCUMENTS

| | | | | |
|---|---|---|---|---|
| 5,768,658 | A * | 6/1998 | Watanabe et al. | 399/111 |
| 6,097,908 | A * | 8/2000 | Uchiyama et al. | 399/111 |
| 6,275,668 | B1 * | 8/2001 | Batori | 399/90 |
| 6,366,749 | B1 * | 4/2002 | Koumoto | 399/113 |
| 6,519,430 | B2 * | 2/2003 | Higeta et al. | 399/109 |
| 6,571,070 | B2 | 5/2003 | Oguma et al. | |
| 2003/0095808 | A1 * | 5/2003 | Takami | 399/71 |
| 2003/0118383 | A1 * | 6/2003 | Endo et al. | 399/350 |
| 2003/0123896 | A1 * | 7/2003 | Goto et al. | 399/90 |
| 2004/0131379 | A1 * | 7/2004 | Numagami et al. | 399/90 |
| 2005/0019056 | A1 * | 1/2005 | Nishimura | 399/98 |
| 2005/0025522 | A1 * | 2/2005 | Tsuzuki et al. | 399/111 |
| 2005/0069338 | A1 * | 3/2005 | Oguma et al. | 399/90 |
| 2006/0024080 | A1 * | 2/2006 | Chadani et al. | 399/90 |
| 2006/0062589 | A1 * | 3/2006 | Sasaki et al. | 399/90 |
| 2006/0110181 | A1 * | 5/2006 | Kubota et al. | 399/90 |

(Continued)

FOREIGN PATENT DOCUMENTS

EP 1239346 A2 * 9/2002

(Continued)

OTHER PUBLICATIONS

Translation of JP2000-112318A to Onimura et al.*

*Primary Examiner* — Quana M Grainger
(74) *Attorney, Agent, or Firm* — McDermott Will & Emery LLP

(57) ABSTRACT

A cartridge is detachably mountable in an image-forming device, the image-forming device having a power supply supplying a bias. The cartridge includes: a bias-receiving member; a casing; and a terminal member. The bias-receiving member is configured to receive a bias supplied from a power supply provided in the image-forming device. The casing is configured to accommodate the bias-receiving member. The casing has an opening formed therein. The terminal member is detachably mounted in the opening formed in the casing and exposed outside the casing via the opening to electrically connect the power supply to the bias-receiving member. The terminal member includes: a return-restricting part restricting the terminal member from returning into the casing; a projection-restricting part that restricts the terminal member from further protruding out of the casing; and a contact part that is positioned outside the casing and that is electrically connected to the power supply.

28 Claims, 23 Drawing Sheets

U.S. PATENT DOCUMENTS

| | | | | |
|---|---|---|---|---|
| 2008/0159775 | A1 * | 7/2008 | Koishi et al. | 399/90 |

FOREIGN PATENT DOCUMENTS

| | | | | |
|---|---|---|---|---|
| JP | 6-59559 | A | | 3/1994 |
| JP | 6-118768 | A | | 4/1994 |
| JP | 6-289736 | A | | 10/1994 |
| JP | 7-146600 | A | | 6/1995 |
| JP | 7-219352 | A | | 8/1995 |
| JP | 07219308 | A | * | 8/1995 |
| JP | 9-319239 | A | | 12/1997 |
| JP | 9-325628 | A | | 12/1997 |
| JP | 10-123797 | A | | 5/1998 |
| JP | 11-316503 | A | | 11/1999 |
| JP | 2000112318 | A | * | 4/2000 |
| JP | 2001201996 | A | * | 7/2001 |
| JP | 2001-265196 | A | | 9/2001 |
| JP | 2003-195700 | A | | 7/2003 |
| JP | 2004102141 | A | * | 4/2004 |
| JP | 2004-205964 | A | | 7/2004 |
| JP | 2004-309861 | A | | 11/2004 |

* cited by examiner

PROCESS CARTRIDGE WITH MEMBER FOR ELECTRICAL CONNECTION TO IMAGE-FORMING DEVICE

CROSS REFERENCE TO RELATED APPLICATIONS

This application claims priority from Japanese Patent Application Nos. 2005-157780 filed May 30, 2005 and 2005-173958 filed Jun. 14, 2005. The entire content of each of these priority applications is incorporated herein by reference.

TECHNICAL FIELD

The disclosure relates to an image-forming device, such as a laser printer, and a process cartridge that is provided in the image-forming device.

BACKGROUND

Conventional image-forming devices, such as laser printers, commonly include a process cartridge that is detachably mounted in a main casing of the image-forming device. The process cartridge includes a photosensitive drum on which electrostatic latent images are formed.

This type of process cartridge also induces a charger for charging the photosensitive drum, a transfer roller for transferring a visible image formed by developing an electrostatic latent image onto paper, and a cleaning member for removing paper dust deposited on the photosensitive drum after the transfer process. With this configuration, a charging bias is applied to the charger, a transfer bias to the transfer roller, and a cleaning bias to the cleaning member.

To achieve this, a power supply is provided in the main casing of the image-forming device, and a terminal member is provided in the process cartridge for applying a bias to each of the charger, transfer roller, and cleaning member. When the process cartridge is mounted in the image-forming device, the terminal member is capable of contacting or separating from a fixed contact point connected to the power supply provided in the main casing. The power supply applies a bias from the fixed contact point to each of the charger, transfer roller, and cleaning member via the terminal member.

One such process cartridge disclosed in U.S. Pat. No. 6,571,070 includes a cartridge-side contact point provided on an outside surface of the process cartridge that can be electrically connected to a contact point on the main assembly of the apparatus when the process cartridge is mounted in the apparatus.

SUMMARY

However, it is important that the terminal member in the process cartridge described above be positioned with great accuracy so that the terminal member can contact and separate from the fixed contact point provided on the main assembly when the process cartridge is mounted in and removed from the main assembly. Positioning of the terminal member must be sufficiently accurate to provide resistance against the pressing force of the fixed contact point in order to maintain firm contact with the fixed contact point when the process cartridge is mounted in the main assembly.

In order to position the terminal member with accuracy, it is necessary to provide special positioning members or to perform a complex assembly operation, leading to higher manufacturing costs and lower productivity.

A process cartridge, disclosed in Japanese unexamined patent application publication No. 22003-195700A, includes a developing roller for carrying toner, a photosensitive drum disposed in confrontation with the developing roller and on which an electrostatic latent image is formed, and a transfer roller disposed in confrontation with the photosensitive drum for transferring a visible image formed on the photosensitive drum with the toner onto paper.

In this type of process cartridge, toner carried on the developing roller is selectively supplied to the electrostatic latent image formed on the photosensitive drum in order to develop the latent image on the photosensitive drum into a visible image. As the visible image formed on the photosensitive drum rotates opposite a sheet of paper passing between the photosensitive drum and the transfer roller, a transfer bias applied to the transfer roller causes the visible image to transfer onto the paper, thereby forming an image on the paper.

In order to prevent permanent deformation of the transfer roller, it is conceivable to accommodate the roller shaft of the transfer roller in the casing of the process cartridge in a loosely fitted state so as to contact the photosensitive drum when the process cartridge is mounted in the main casing of an image-forming device and to separate from the photosensitive drum when the process cartridge is removed from the main casing. It is conceivable to provide this type of process cartridge with an electrode member for transmitting a transfer bias applied by a power supply provided in the main casing to the transfer roller, as illustrated in FIG. 1.

Specifically, the process cartridge shown in FIG. 1 includes a casing 1150, and a transfer roller 1151 accommodated in the casing 1150. Support members 1153 are provided in the casing 1150 for supporting a roller shaft 1152 of the transfer roller 1151 in a loosely fitted state. The roller shaft 1152 is loosely supported in the support member 1153 so that an axial endface of the roller shaft 1152 does not protrude out of the casing 1150. The casing 1150 has a side wall 1154. An opening 1155 is formed in the side wall 1154 at a position opposing, but separated a prescribed distance from, the axial endface of the roller shaft 1152.

An electrode member 1156 is integrally configured of an electrode body 1157 that is substantially cylindrical in shape, and a flange part 1159 formed on a base end of the electrode body 1157 and having a larger diameter than the electrode body 1157. The base end of the electrode body 1157 contacts an axial endface of the roller shaft 1152 inside the casing 1150, and the outer end of the electrode body 1157 protrudes out of the casing 1150 via the opening 1155 while the flange part 1158 is supported in a pinched state between the side wall 1154 and the axial endface of the roller shaft 1152.

A power-feeding member 1159 having a leaf spring shape and connected to a power supply is provided in the main casing of the image-forming device and contacts the outside end of the electrode body 1157 when the process cartridge is mounted in the image-forming device. The power supply applies a transfer bias to the roller shaft 1152 through the power-feeding member 1159 and electrode 1156.

This type of process cartridge is assembled by first fitting the electrode member 1156 into the opening 1155 from inside the casing 1150 so that the outside end of the electrode body 1157 protrudes out of the casing 1150 and the flange part 1158 is placed in contact with the side wall 1154. Next, the roller shaft 1152 of the transfer roller 1151 is inserted into the support member 1153 so that the axial end of the roller shaft 1152 contacts the base end of the electrode body 1157.

However, assembly of this process cartridge is inefficient since the transfer roller 1151 is mounted after fitting the electrode member 1156 through the opening 1155 from inside the casing 1150, making it difficult to improve productivity and requiring extra labor for replacement and repair.

In view of the foregoing, it is an object of the invention to provide a cartridge capable of facilitating the assembly operation and improving productivity and simplify the replacement operation, and an image-forming device equipped with the cartridge.

It is another object of the invention to provide a cartridge having a simple structure for accurately assembling an electrode member or a terminal member with respect to the casing, and an image-forming device provided with the cartridge.

In order to attain the above and other objects, an aspect of the invention provided a cartridge that is detachably mountable in an image-forming device, the image-forming device having a power supply supplying a bias. The cartridge includes: a bias-receiving member; a casing; and a terminal member. The bias-receiving member is configured to receive a bias supplied from a power supply provided in the image-forming device. The casing is configured to accommodate the bias-receiving member. The casing has an opening formed therein. The terminal member is detachably mounted in the opening formed in the casing and exposed outside the casing via the opening to electrically connect the power supply to the bias-receiving member. The terminal member includes: a return-restricting part restricting the terminal member from returning into the casing; a projection-restricting part that restricts the terminal member from further protruding out of the casing; and a contact part that is positioned outside the casing and that is electrically connected to the power supply.

Another aspect of the invention provides an image-forming device including: a housing; a power supply mounted in the housing and supplying a bias; a cartridge that is detachably mountable in the housing; and a fixing unit that is mounted in the housing. The cartridge includes: a bias-receiving member; a casing; a terminal member; an image-carrying member that carries a developer image; and a charging unit. The bias-receiving member is configured to receive a bias supplied from the power supply. The casing is configured to accommodate the bias-receiving member. The casing has an opening formed therein. The terminal member is detachably mounted in the opening formed in the casing and exposed outside the casing via the opening to electrically connect the power supply to the bias-receiving member. The terminal member includes: a return-restricting part restricting the terminal member from returning into the casing; a projection-restricting part that restricts the terminal member from further protruding out of the casing; and a contact part that is positioned outside the casing and that is electrically connected to the power supply. The image-carrying member carries a developer image. The charging unit has a discharge wire supplying an electrical charge to the image-carrying member. The bias-receiving member includes a grid that controls the amount of electrical charge that the discharge wire supplies to the image-carrying member. The fixing unit fixes the developer image transferred onto a recording medium from the image-carrying member.

Another aspect of the invention provides an image-forming device including a housing; a power supply mounted in the housing and supplying a bias; a cartridge that is detachably mountable in the housing; and a fixing unit that is mounted in the housing. The cartridge includes: a bias-receiving member; a casing; a terminal member; and an image-carrying member. The bias-receiving member is configured to receive a bias supplied from the power supply. The casing is configured to accommodate the bias-receiving member. The casing has an opening formed therein. The terminal member is detachably mounted in the opening formed in the casing and exposed outside the casing via the opening to electrically connect the power supply to the bias-receiving member. The terminal member includes: a return-restricting part restricting the terminal member from returning into the casing; a projection-restricting part that restricts the terminal member from further protruding out of the casing; and a contact part that is positioned outside the casing and that is electrically connected to the power supply. The image-carrying member carries a developer image. The bias-receiving member includes a cleaning member that removes foreign matter deposited on the image-carrying member. The fixing unit fixes the developer image transferred onto a recording medium from the image-carrying member.

Another aspect of the invention provides an image-forming device including: a housing; a power supply mounted in the housing and supplying a bias, a cartridge that is detachably mountable in the housing; and a fixing unit that is mounted in the housing. The cartridge includes: a bias-receiving member; a casing; a terminal member; a roller member; an electrode member; and a photosensitive member. The bias-receiving member is configured to receive a bias supplied from the power supply. The casing is configured to accommodate the bias-receiving member. The casing has an opening formed therein. The terminal member is detachably mounted in the opening formed in the casing and exposed outside the casing via the opening to electrically connect the power supply to the bias-receiving member. The terminal member includes: a return-restricting part restricting the terminal member from returning into the casing; a projection-restricting part that restricts the terminal member from further protruding out of the casing; and a contact part that is positioned outside the casing and that is electrically connected to the power supply. The roller member receives another bias supplied from the power supply, the casing accommodating the roller member. The casing has another opening formed therein. The electrode member is inserted into the casing from the outer side thereof via the another opening formed in the casing and contacts an end of the roller member in its axial direction to electrically connect the power supply to the roller member. The photosensitive member carries an electrostatic latent image on the surface thereof and receives a developer for developing the electrostatic latent image into a visible image. The roller member including a transfer roller that transfers the visible image formed on the photosensitive member onto a recording medium. The transfer roller is supported in the casing in a loosely fitted state so as to contact the photosensitive member when the cartridge is mounted in the housing and to separate from the photosensitive member when the cartridge is removed from the housing. The fixing unit fixes the visible image transferred onto a recording medium from the photosensitive member.

Another aspect of the invention provides a cartridge that is detachably mountable in an image-forming device, the image-forming device having a power supply supplying a bias. The cartridge includes: a roller member that receives a bias supplied from a power supply provided in the image-forming device; a casing that accommodates the roller member and that has an opening formed therein; and an electrode member inserted into the casing from the outer side thereof via the opening formed in the casing and contacting an end of the roller member in its axial direction to electrically connect the power supply to the roller member.

Another aspect of the invention provides an image-forming device including: a housing; a power supply mounted in the housing and supplying a bias; a cartridge that is detachably mountable in the housing; and a fixing unit that is mounted in the housing. The cartridge includes: a roller member; a casing; an electrode member; and a photosensitive member. The roller member receives a bias supplied from a power supply provided in the image-forming device. The casing accommodates the roller member. The casing has an opening formed therein. The electrode member is inserted into the casing from the outer side thereof via the opening formed in the casing and contacts an end of the roller member in its axial direction to electrically connect the power supply to the roller member. The photosensitive member carries an electrostatic latent image on the surface thereof and receives a developer for developing the electrostatic latent image into a visible image. The roller member includes a transfer roller that transfers the visible image formed on the photosensitive member onto a recording medium. The transfer roller is supported in the casing in a loosely fitted state so as to contact the photosensitive member when the cartridge is mounted in the housing and to separate from the photosensitive member when the cartridge is removed from the housing. The fixing unit fixes the visible image transferred onto a recording medium from the photosensitive member.

BRIEF DESCRIPTION OF THE DRAWINGS

Illustrative aspects in accordance with the invention will be described in detail with reference to the following figures wherein.

DETAILED DESCRIPTION

Figure 1:
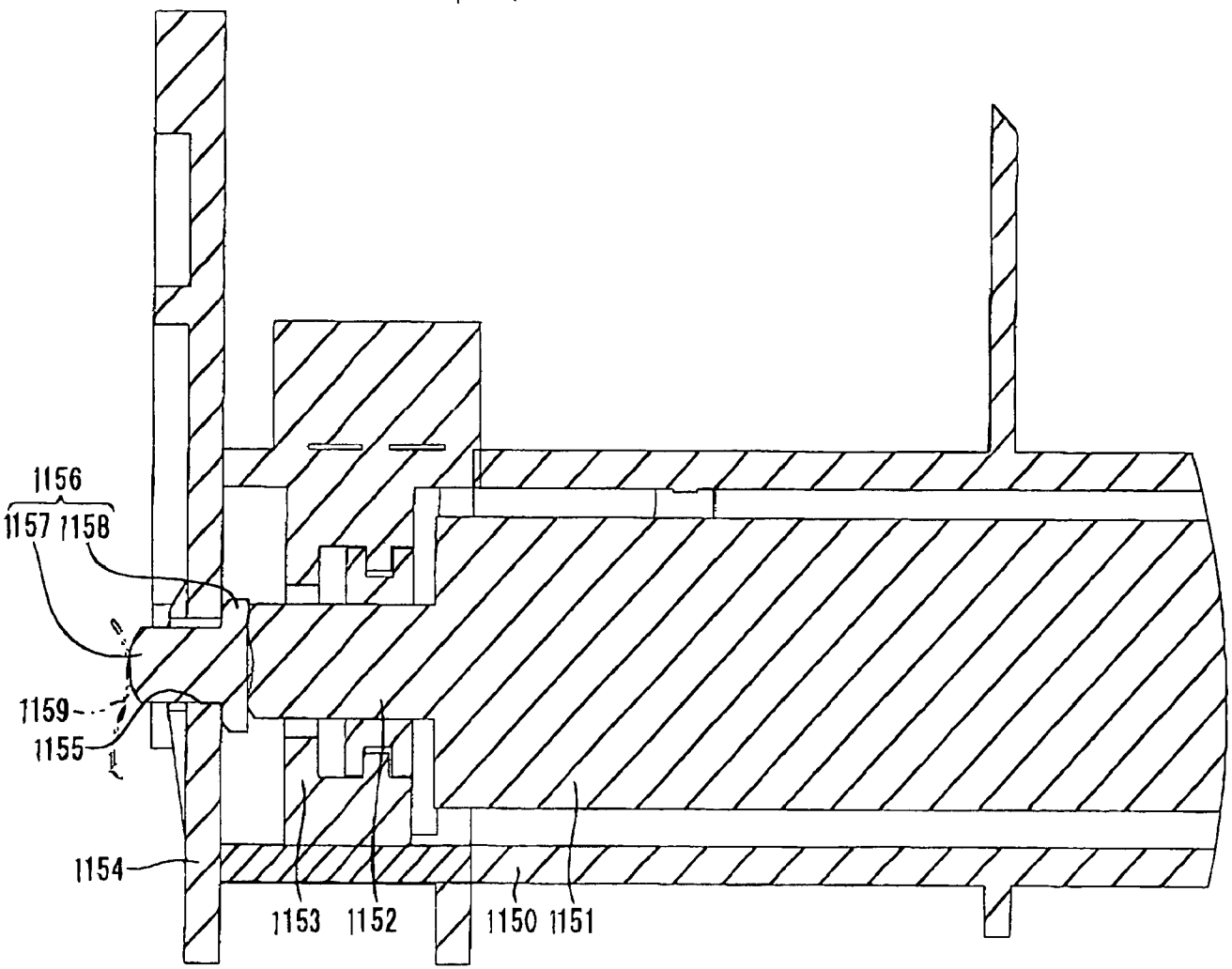
FIG. 1 is a cross-sectional view showing a conceivable process cartridge having an electrode member for applying a transfer bias to a transfer roller.

A process cartridge for an image forming-device according to some aspects of the invention will be described while referring to the accompanying drawings wherein like parts and components are designated by the name reference numerals to avoid duplicating description.

1. General Structure of a Laser Printer

Figure 2:
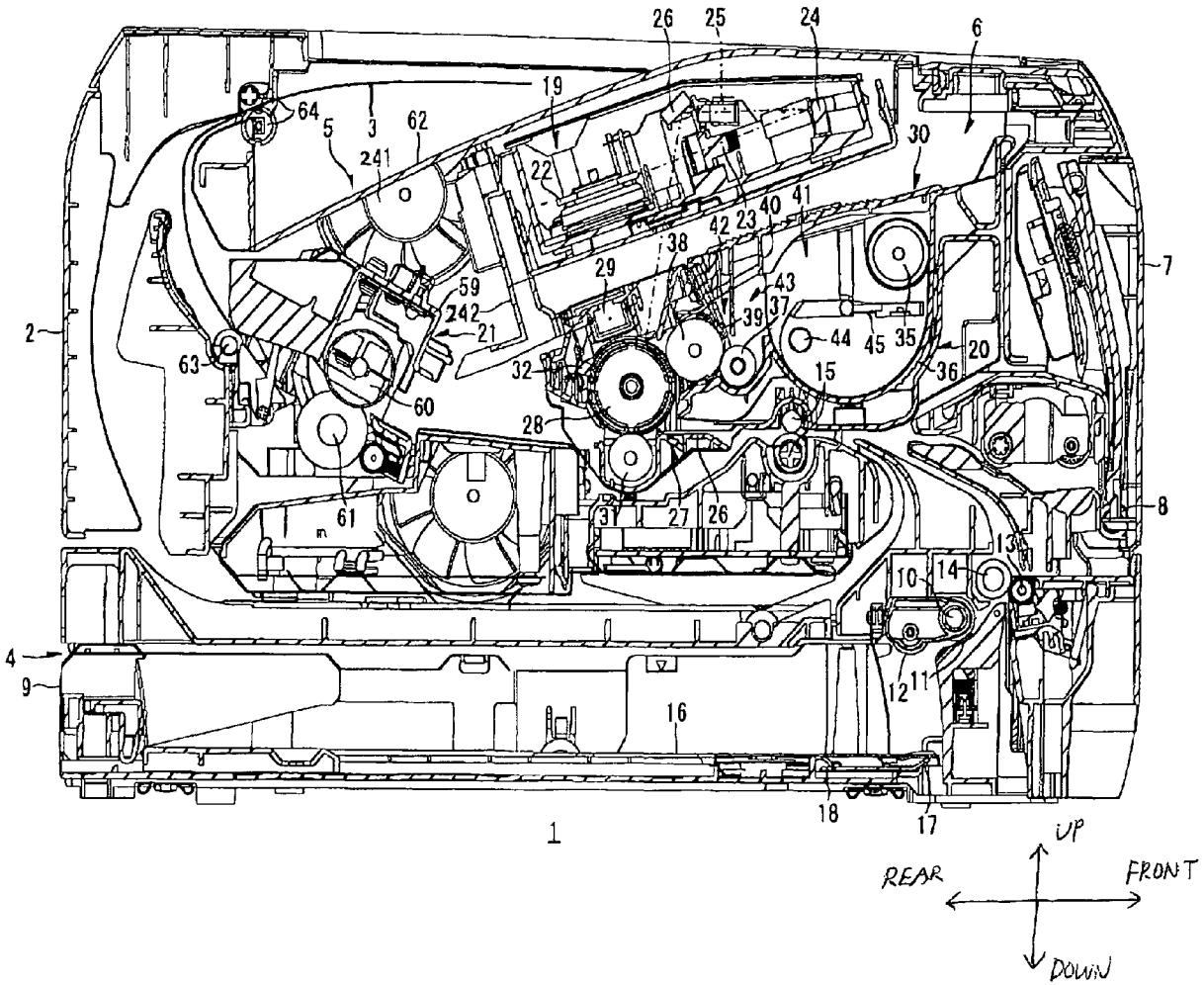
FIG. 2 is a side cross-sectional view of a laser printer according to an aspect of the invention.
Figure 3:
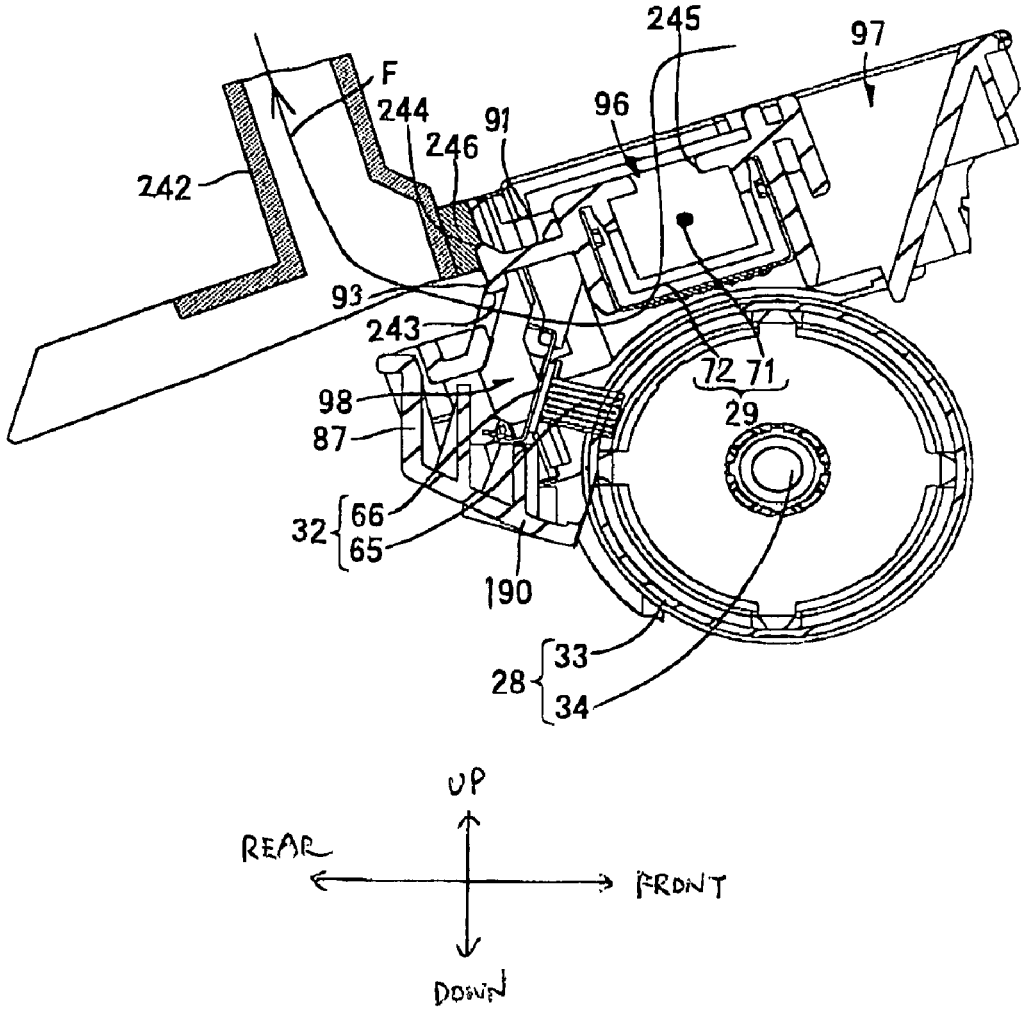
FIG. 3 is a side cross-sectional view showing a duct and an upper rear part of a process cartridge employed in the laser printer of FIG. 2.
Figure 4:
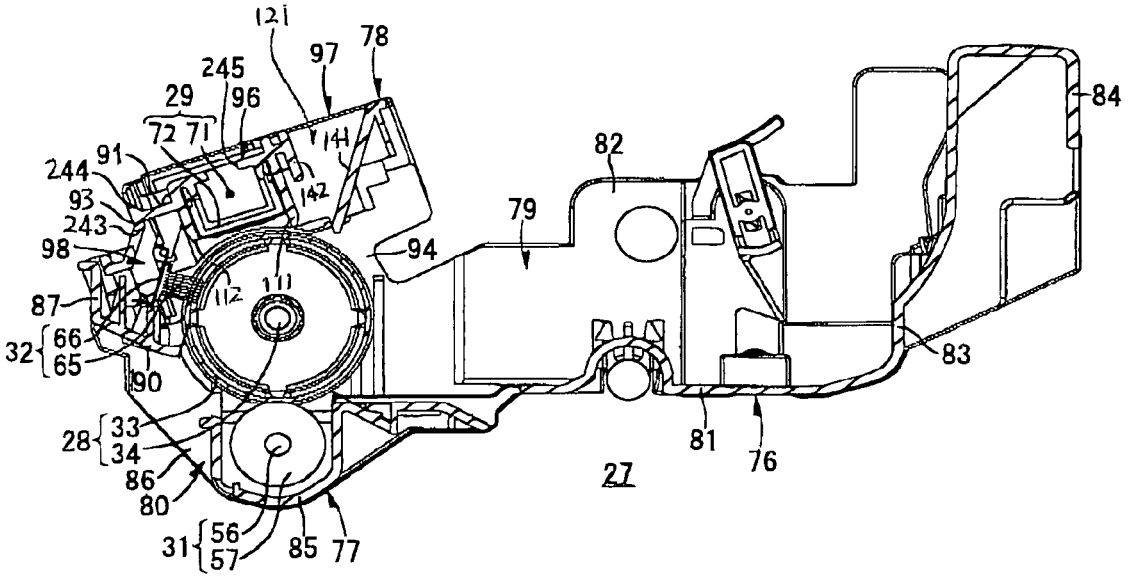
FIG. 4 is a side cross-sectional view of the drum cartridge employed in the laser printer of FIG. 2.
Figure 5:
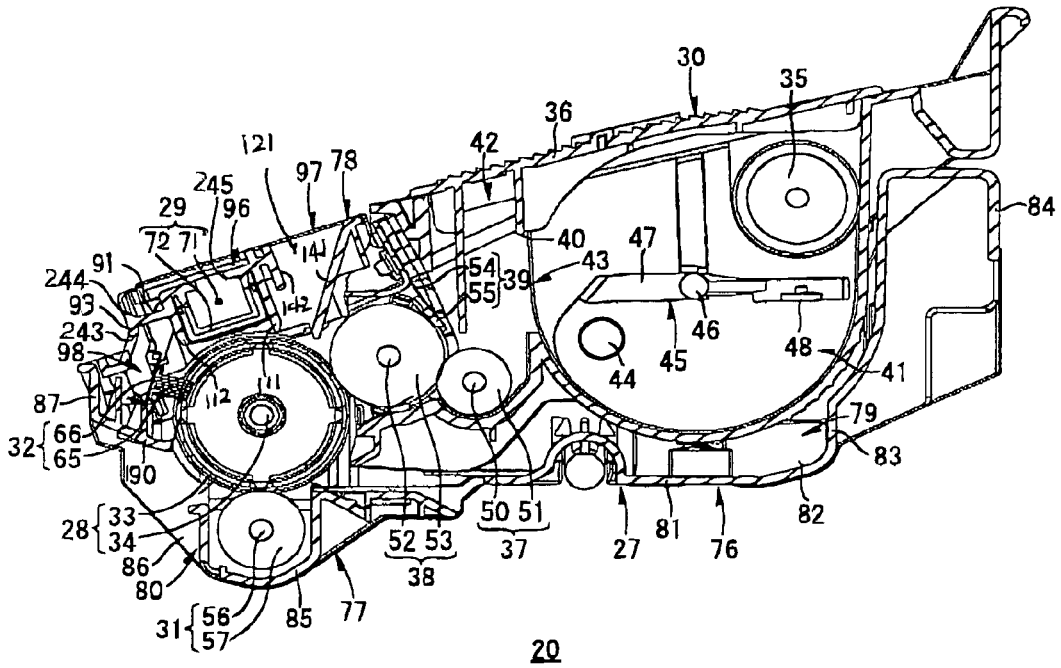
FIG. 5 is a side cross-sectional view of the process cartridge employed in the laser printer of FIG. 2.

FIG. 2 is a side cross-sectional view of a laser printer 1 according to one aspect of the invention. FIG. 3 is a side cross-sectional view showing a duct 242 and an upper rear part of a process cartridge 20 mounted in the laser printer 1. FIG. 4 is a side cross-sectional view of a drum cartridge 27. FIG. 5 is a side cross-sectional view of the process cartridge 20 employed in the laser printer 1.

As shown in FIG. 2, the laser printer 1 includes a main casing 2 and, within the man casing 2, a feeding unit 4 for supplying a sheet of paper 3, and an image-forming unit 5 for forming an image on the paper 3 supplied by the feeding unit 4.

(1) Main Casing

The laser printer 1 also includes an access opening 6 formed in one side wall of the main casing 2 for inserting and removing a process cartridge 20 described later, and a front cover 7 capable of opening and closing over the access opening 6. The front cover 7 is rotatably supported by a cover shaft 8 inserted through a bottom edge of the front cover 7. Accordingly, when the front cover 7 is rotated closed about the cover shaft 8, the front cover 7 covers the access opening 6, as shown in FIG. 2. When the front cover 7 is rotated open about the cover shaft 8, the access opening 6 is exposed, enabling the process cartridge 20 to be mounted into or removed from the main casing 2 via the access opening 6.

The terms "upper", "lower", "right", "left", "front", "rear" and the like will be used throughout the description assuming that the laser printer 1 is disposed in an orientation in which it is intended to be used and that the process cartridge 20 is mounted in the laser printer 1. In use, the laser printer 1 is disposed and the process cartridge 20 is mounted in the laser printer 1 as shown in FIG. 2. Hence, the side of the laser printer 1 on which the front cover 7 is mounted and the corresponding side of the process cartridge 20 when the process cartridge 20 is mounted in the main casing 2 will be referred to as the "front side", while the opposite side will be referred to as the "rear side". The right-to-left direction will be referred to also as a "width direction". A vertical direction will be referred to also as a "height direction".

The main casing 2 is also provided with an exhaust fan 241 for exhausting air out of the main casing 2; and a duct 242 for guiding air toward the exhaust fan 241. The exhaust fan 241 is disposed above a fixing unit 21 described later.

The duct 242 is disposed rearward of a scanning unit 19 described later and extends vertically. As shown in FIG. 3, the top end of the duct 242 leads toward the exhaust fan 241, while the bottom end extends near the rear side of openings 243 formed in the process cartridge 20 described later.

The process cartridge 20 described later has a top wall 91. A sponge member 246 is provided on the lower end of the duct 242 and on the front side thereof for contacting a rear endface of the top wall 91.

(2) Feeding Unit

The feeding unit 4 includes a paper tray 9 that can be inserted into or removed from a lower section of the main casing 2 in the front-to-rear direction, a separating roller 10 and a separating pad 11 disposed above a front end of the paper tray 9, and a feeding roller 12 disposed on the rear side of the separating roller 10 upstream of the separating pad 11 with respect to the conveying direction of the paper 3 (hereinafter referred to as the "paper-conveying direction"). The feeding unit 4 also includes a paper dust roller 13 disposed above and forward of the separating roller 10 and downstream of the separating roller 10 in the paper-conveying direction, and a pinch roller 14 disposed in opposition to the paper dust roller 13.

A paper-conveying path for the paper 3 on the feeding and reverses directions toward the rear side of the laser printer 1, forming a substantial U-shape near the paper dust roller 13. The feeding unit 4 also includes a pair of registration rollers 15 disposed below the process cartridge 20 farther downstream of the U-shaped portion of the paper-conveying path with respect to the paper-conveying direction.

A paper-pressing plate 16 is provided inside the paper tray 9 for supporting the sheets of paper 3 in a stacked state. The paper-pressing plate 16 is pivotably supported on the rear end thereof, so that the front end can pivot downward to a resting position in which the paper-pressing plate 16 rests on a bottom plate of the paper tray 9 and can pivot upward to a feeding position in which the paper-pressing plate 16 slopes upward from the rear end to the front end.

A lever 17 is provided in the front section of the paper tray 9 for lifting the front end of the paper-pressing plate 16 upward. The rear end of the lever 17 is pivotably supported on a lever shaft 18 at a position below the front end of the paper-pressing plate 16 so that the front end of the lever 17 can pivot between a level position in which the lever 17 lies along the bottom plate of the paper tray 9 and a sloped position in which the front end of the lever 17 lifts the paper-pressing plate 16 upward. When a driving force is inputted into the lever shaft 18, the lever 17 rotates about the lever shaft 18 and the front end of the lever 17 raises the front end of the paper-pressing plate 16, shifting the paper-pressing plate 16 into the feeding position.

When the paper-pressing plate 16 is in the feeding position, the topmost sheet of paper 3 stacked on the paper-pressing plate 16 is pressed against the feeding roller 12. The rotating feeding roller 12 begins feeding the sheet of paper 3 toward a separating position between the separating roller 10 and separating pad 11.

When the paper tray 9 is removed from the main casing 2, the paper-pressing plate 16 settles into the resting position. While the paper-pressing plate 16 is in the resting position, sheets of paper 3 can be stacked on the paper-pressing plate 16.

When the feeding roller 12 conveys a sheet of the paper 3 toward the separating position and the sheet becomes interposed between the separating roller 10 and separating pad 11, the rotating separating roller 10 separates and feeds the paper 3 one sheet at a time. Each sheet of paper 3 fed by the separating roller 10 passes between the paper dust roller 13 and pinch roller 10 passes between the paper roller 13 removes paper dust from the sheet of paper 3, the sheet is conveyed along the U-shaped paper-conveying path on the feeding end, thereby reversing directions, and is conveyed toward the registration rollers 15.

After registering the paper 3, the registration rollers 15 convey the paper 3 to a transfer position between a photosensitive drum 28 and a transfer roller 31 described later, at which position a toner image formed on the photosensitive drum 28 is transferred onto the paper 3.

(3) Image-forming Unit

The image-forming unit 5 includes a scanning unit 19, the process cartridge 20, and the fixing unit 21.

(a) Scanning Unit

The scanning unit 19 is disposed in a top section of the main casing 2 and includes a laser light source (not shown), a polygon mirror 22 that can be driven to rotate, an fθ lens 23, a reflecting mirror 24, a lens 29, and a reflecting mirror 26. The laser light source emits a laser beam based on image data. As illustrated by a dotted line in FIG. 2, the laser beam is deflected by the polygon mirror 22, passes through the fθ lens 23, is reflected by the reflecting mirror 24, passes through the lens 25, and is reflected downward by the reflecting mirror 26 to be irradiated on the surface of the photosensitive drum 28 in the process cartridge 20.

(b) Process Cartridge

As shown in FIG. 2, the process cartridge 20 is provided in the main casing 2 beneath the scanning unit 19 and can be mounted in or removed from the main casing 2 through the access opening 6.

As shown in FIG. 5, the process cartridge 20 includes the drum cartridge 27 and a developer cartridge 30 that is detachably mounted on the drum cartridge 27.

As shown in FIG. 4, the drum cartridge 27 includes a drum casing 76 described later in greater detail and, within the drum casing 76, the photosensitive drum 28, a Scorotron charger 29, the transfer roller 31, and a cleaning member 32.

The photosensitive drum 28 includes: a main drum body 33 that is cylindrical in shape and that has a positive charging photosensitive layer formed of polycarbonate or the like on its peripheral surface; and a metal drum shaft 34 extending through the center of the main drum body 33 along the axial direction thereof. The metal drum shaft 34 is supported in the drum casing 76, and the main drum body 33 is rotatably supported relative to the metal drum shaft 34. With this construction, the photosensitive drum 28 is disposed in the drum casing 76 and is capable of rotating about the metal drum shaft 34. Further, the photosensitive drum 28 is driven to rotate by a driving force inputted from a motor (not shown). The axial direction of the drum shaft 34 is parallel to the width direction of the process cartridge 20. Accordingly, the axial direction of the drum shaft 34 is parallel to the width direction of the laser printer 1 when the process cartridge 20 is mounted on the main casing 2.

The charger 29 is supported on the drum casing 76 diagonally above and rearward of the photosensitive drum 28. The charger 29 opposes the photosensitive drum 28 but is separated a prescribed distance from the photosensitive drum 28 so as not to contact the same. The charger 29 includes a discharge wire 71 disposed in opposition to but separated a prescribed distance from the photosensitive drum 28, and a grid 72 provided between the discharge wire 71 and the photosensitive drum 28 for controlling the amount of corona discharge from the discharge wire 71 that reaches the photosensitive drum 28. A grid bias is applied to the grid 72 from a grid terminal 73 (terminal member) (see FIG. 25). At the same time, a high voltage is applied to the discharge wire 71 for generating a corona discharge from the discharge wire 71. Thus, the charger 29 can charge the surface of the photosensitive drum 28 with a uniform positive polarity.

The transfer roller 31 is disposed in the drum casing 76 below the photosensitive drum 28 and contacts the photosensitive drum 28 in a vertical direction from the bottom thereof so as to form a nip part with the photosensitive drum 28. The transfer roller 31 is configured of a metal roller shaft 56 that is covered with a roller 57 formed of an electrically conductive rubber material. The roller shaft 56 is rotatably supported in the drum casing 76. The transfer roller 31 is driven to rotate by a driving force inputted from a motor (not shown). As will be described later, a power supply 300 (FIGS. 7, 14, and 22) is provided in the main casing 2 for applying various types of bias, including a transfer bias, a cleaning bias, and a grid bias. A power-feeding member 230 (FIG. 7) is connected to the power supply 300. During a transfer operation, the power-feeding member 230 transmits a transfer bias from the power supply 300 to the transfer roller 31 via an electrode member 215 described later (see FIG. 11).

The cleaning member 32 is mounted on the drum casing 76 in a position confronting the photosensitive drum 28 from the rear side thereof. As will be described in greater detail later, the cleaning member 32 includes a cleaning brush 65 that captures paper dust deposited on the photosensitive drum 28, and a support plate 66 that supports the rear side of the cleaning brush 65 on the side opposite the photosensitive drum 28.

The cleaning brush 65 is configured of a nonwoven fabric implanted with a plurality of fibrous brush bristles having electrical conductivity, and is fixed to the support plate 66 by a double-sided tape. The cleaning brush 65 is disposed so as to confront and contact the photosensitive drum 28.

The support plate 66 is mounted on the drum casing 76 while supporting the cleaning brush 65.

A cleaning terminal 67 (terminal member) (see FIG. 16) described later elastically contacts one side of the support plate 66 that is opposite to the side where the support plate 66 supports the cleaning brush 65. During a cleaning operation, the cleaning terminal 67 applies a cleaning bias to the cleaning brush 65.

As shown in FIG. 5, the developer cartridge 30 is detachably mounted on the drum casing 76. Accordingly, when the process cartridge 20 is already mounted in the main casing 2, the developer cartridge 30 can be changed with a new one by first opening the front cover 7, subsequently removing the process cartridge 20 through the access opening 6, detaching the developer cartridge 30 from the drum cartridge 27, and attaching the new developer cartridge 30 on the drum cartridge 27.

As shown in FIG. 5, the developer cartridge 30 includes a developer casing 36 and, within the developer casing 36, a supply roller 37, a developing roller 38, and a thickness-regulating blade 39.

The developer casing 36 is formed in a box shape that is open on the rear side. A partitioning wall 40 is provided in the developer casing 36 for partitioning the interior of the developer casing 36 into a toner-accommodating chamber 41 and a developing chamber 42.

The partitioning wall 40 is disposed at a position in the developer casing 36 midway in the front-to-rear direction for partitioning the interior of the developer casing 36 in the front-to-rear direction. An opening 43 penetrates a midway region of the partitioning wall 40.

The toner-accommodating chamber 41 occupies a space in the front side of the casing 36 partitioned by the partitioning wall 40. The toner-accommodating chamber 41 is filled with a nonmagnetic, single-component toner having a positive charging nature. The toner used in this example is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

A toner supply opening for filling the toner-accommodating chamber 41 with toner is formed in a side wall of the developer casing 36 that defines the toner-accommodating chamber 41. The toner supply opening is sealed with a cap 35.

Toner detection windows 44 are provided in both side walls of the casing 36 that define the toner-accommodating chamber 41 for detecting the amount of toner remaining in the toner-accommodating chamber 41. The toner detection windows 44 are formed in the side walls of the casing 36 near the partitioning wall 40 and oppose each other in the width direction (the direction orthogonal to the front-to-rear direction and the vertical across the toner-accommodating chamber 41. The toner detection windows 44 are formed by embedding a transparent disc-shaped plate in each side wall of the casing 36.

The agitator 45 is disposed in the toner-accommodating chamber 41 for agitating toner accommodated therein. The agitator 45 includes a rotational shaft 46 and an agitating member 47.

The rotational shaft 46 is rotatably supported in the side walls of the casing 36 substantially in the center of the toner-accommodating chamber 41. The agitating member 47 is provided on the rotational shaft 46. A motor (not shown) produces a driving force that is inputted into the rotational shaft 46 for driving the rotational shaft 46 to rotate. Consequently, the agitating member 47 moves in a circular path about the rotational shaft 46 through the toner-accommodating chamber 41 and stirs toner accommodated in the toner-accommodating chamber 41. When the agitating member 47 stirs the toner, some of the toner is discharged in the front-to-rear direction toward the supply roller 37 through the opening 43 formed in the partitioning plate 40.

The agitator 45 also includes wipers 48 attached at both axial ends of the rotational shaft 46. When the rotational shaft 46 rotates, the wipers 48 move in a circular direction about the rotational shaft 46 through the toner-accommodating chamber 41 in order to wipe the toner detection windows 44 provided in the side walls of the casing 36. Hence, the wipers 48 function to clean the toner detection windows 44.

The developing chamber 42 occupies an interior space in the rear side of the casing 36 partitioned by the partitioning wall 40. The developing chamber 42 accommodates the supply roller 37, the developing roller 38, and the thickness-regulating blade 39.

The supply roller 37 is disposed rearward of the opening 43 in the developing chamber 42 and includes a metal roller shaft 50 covered by a sponge roller 31 formed of an electrically conductive foam material. The roller shaft 50 is rotatably supported within the developing chamber 42 in both side walls of the casing 36. The supply roller 37 is driven to rotate by a driving force inputted into the roller shaft 50 from a motor (not shown).

The developing roller 38 is disposed rearward of the supply roller 37 and contacts the supply roller 37 with pressure so that both are compressed. The developing roller 38 includes a metal roller shaft 52, and a rubber roller 53 formed of an electrically conductive rubber material that covers the roller shaft 52. The roller shaft 52 is rotatably supported in the pair of the side walls of the casing 36 within the developing chamber 42. The rubber roller 53 is more specifically formed of an electrically conductive urethane rubber of silicone rubber containing fine carbon particles, the surface of which is coated with urethane rubber or silicone rubber containing fluorine. The developing roller 38 is driven to rotate by a driving force inputted into the roller shaft 52 from a motor (not shown). Further, a developing bias is applied to the developing roller 38 during a developing operation.

The thickness-regulating blade 39 includes a main blade member 54 configured of a metal leaf spring, and a pressing part 55 provided on a distal end of the main blade member 54. The pressing part 55 has a semicircular cross section and is formed of an insulating silicone rubber. A base end of the main blade member 54 is supported on the developer casing 36 above the developing roller 38, and the pressing part 55 contacts the developing roller 38 with pressure through the elastic force of the main blade member 54.

Toner discharged through the opening 43 is supplied onto the developing roller 38 by the rotating supply roller 37. At this time, the toner is positively tribocharged between the supply roller 37 and the developing roller 38. As the developing roller 38 rotates, the toner supplied to the surface of the developing roller 38 passes between the rubber roller 53 of the developing roller 38 and the pressing part 55 of the thickness-regulating blade 39, thereby forming a layer of toner of a uniform thickness on the surface of the developing roller 38.

As the photosensitive drum 28 rotates, the charger 29 charges the surface of the photosensitive drum 28 with a uniform positive polarity. Subsequently, a laser beam emitted from the scanning unit 19 is scanned at a high speed over the surface of the photosensitive drum 28, forming an electrostatic latent image corresponding to an image to the formed on the paper 3.

Next, positively charged toner carried on the surface of the developing roller 38 comes into contact with the photosensitive drum 28 as the developing roller 38 rotates and is supplied to areas on the surface of the positively charged photosensitive drum 28 that have been exposed to the laser beam and, therefore, have a lower potential. In this way, the latent image on the photosensitive drum 28 is transformed into a visible image according to a reverse developing process so that a toner image is carried on the surface of the photosensitive drum 28.

Subsequently, as the registration rollers 15 convey a sheet of paper 3 into the drum casing 76 and through the transfer position between the photosensitive drum 28 and transfer roller 31, the toner image carried on the surface of the photosensitive drum 28 is transferred onto the paper 3 by the transfer bias applied to the transfer roller 31. The paper 3 on which the toner is transferred is conveyed to the fixing unit 21.

Toner remaining on the surface of the photosensitive drum 28 after a transfer has been made is recovered by the developing roller 38. Further, paper dust that has been deposited from the paper 3 onto the surface of the photosensitive drum 28 is physically scraped off by the cleaning brush 65 of the cleaning member 32 and is electrically absorbed to the cleaning brush 65 due to the cleaning bias applied from the cleaning terminal 67.

(c) Fixing Unit

As shown in FIG. 2, when the process cartridge 20 is mounted in the main casing 2, the fixing unit 21 is disposed on the rear side of the process cartridge 20 and is separated from the photosensitive drum 28 of the process cartridge 20 in a substantially horizontal direction. The fixing unit 21 includes a fixing frame 59; and a heating roller 60 and a pressure roller 61 provided within the fixing frame 59.

The heating roller 60 includes a metal tube, the surface of which is coated with a fluorine resin, and a halogen lamp disposed inside the metal tube for heating the same. The heating roller 60 is driven to rotate by a driving force inputted from a motor (not shown).

The pressure roller 61 is disposed below and in opposition to the heating roller 60 and contacts the heating roller 60 with pressure. The pressure roller 61 is configured of a metal roller shaft covered with a roller that is formed of a rubber material. The pressure roller 61 follows the rotational drive of the heating roller 60.

In the fixing unit 21, a toner image transferred onto the paper 3 at the transfer position in fixed to the paper 3 by heat as the paper 3 passes between the heating roller 60 and pressure roller 61. After the toner image is fixed to the paper 3, the heating roller 60 and pressure roller 61 continue to convey the paper 3 toward a discharge tray 62 formed on the top surface of the main casing 2.

A paper-conveying path on the discharge and leads from the fixing unit 21 to the discharge tray 65 and is substantially U-shaped for reversing the conveying direction of the paper 3 to a direction toward the front of the laser printer 1. A conveying roller 63 is disposed at a midpoint along the discharge end paper-conveying path, and a pair of discharge rollers 64 is disposed at downstream end of the same path.

Hence, after passing through the fixing unit 21, the paper 3 is conveyed along the discharge and paper-conveying path, where the conveying roller 63 receives and conveys the paper 3 to the discharge rollers 64, and the discharge rollers 64 subsequently receive and discharge the paper 3 onto the discharge tray 62.

2. 1 Drum Casing, Transfer Roller, Cleaning Member, and Grid

Figure 6:
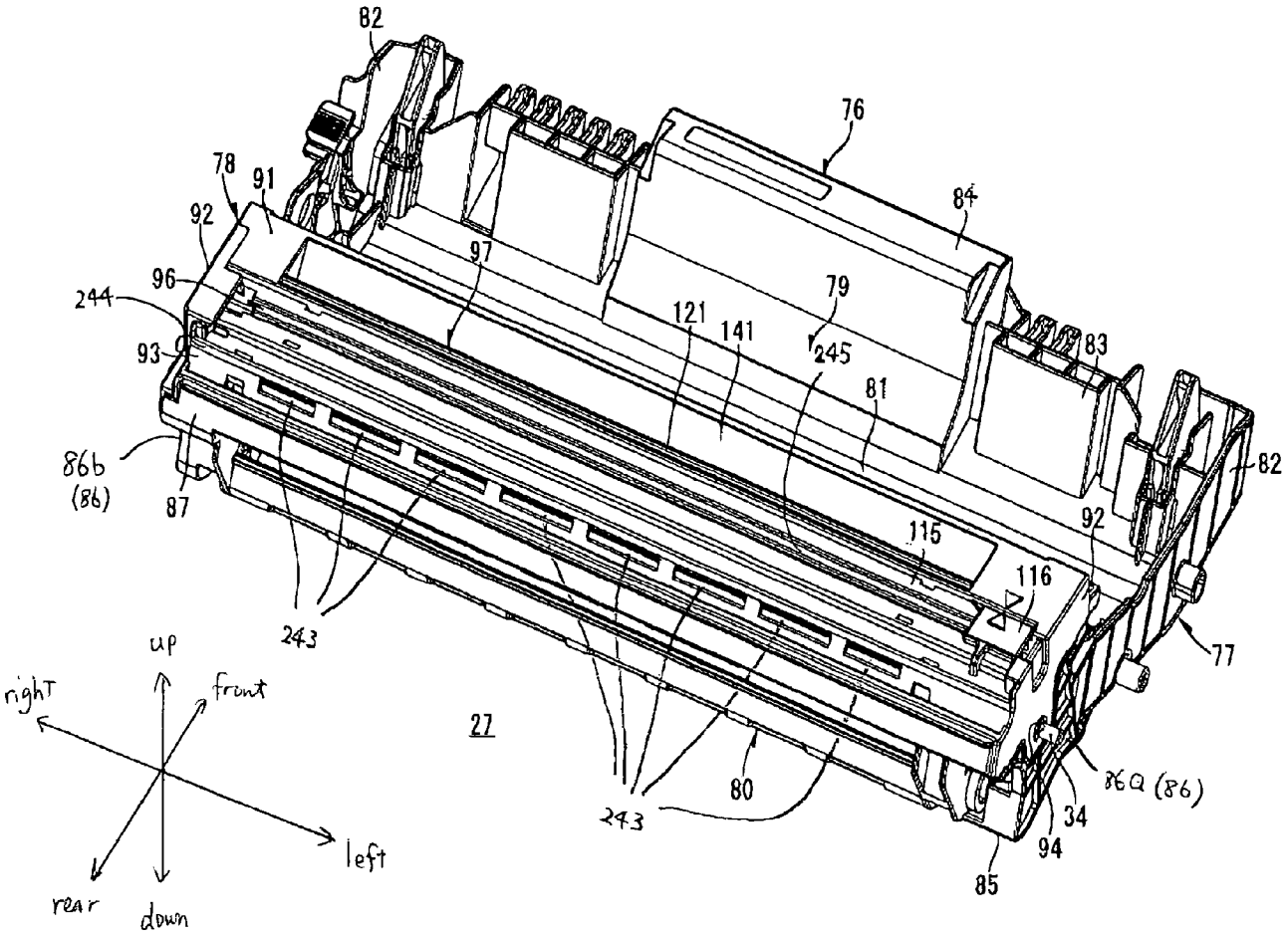
FIG. 6 is a perspective view from above the rear side of the drum cartridge.
Figure 7:
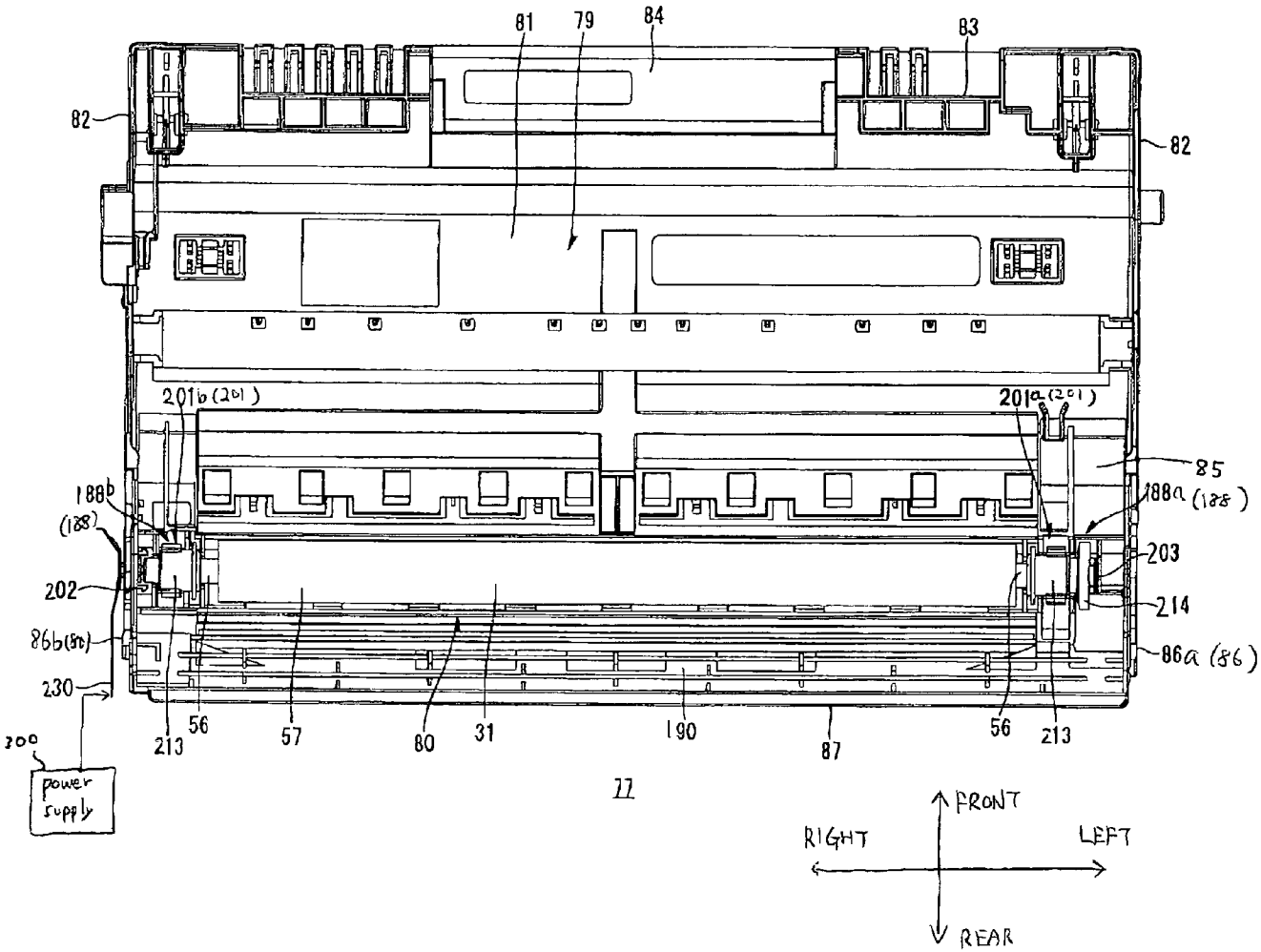
FIG. 7 is plan view of the drum cartridge in FIG. 6, omitting the upper casing and the photosensitive drum.
Figure 8:
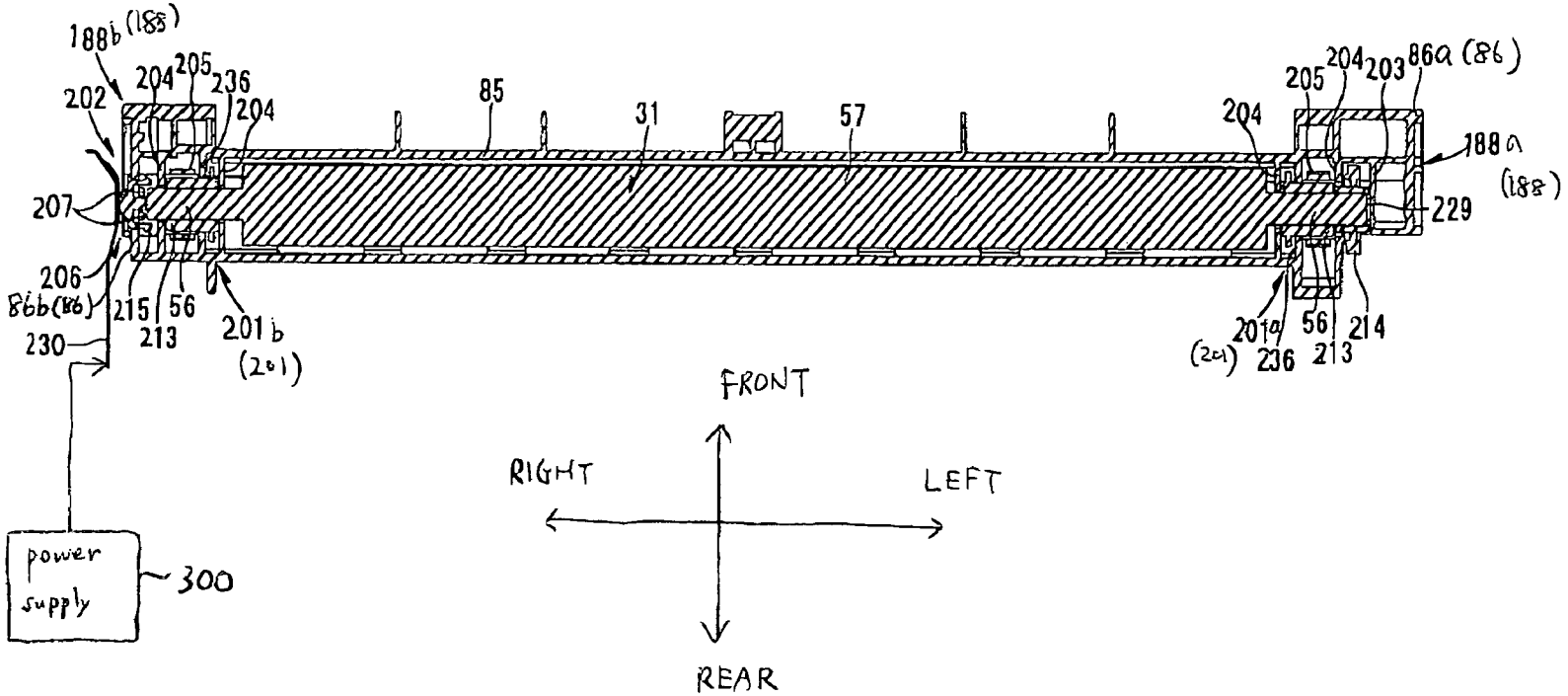
FIG. 8 is a horizontal cross-sectional view of the drum cartridge in FIG. 7 taken along the center axis of the transfer roller.
Figure 9:
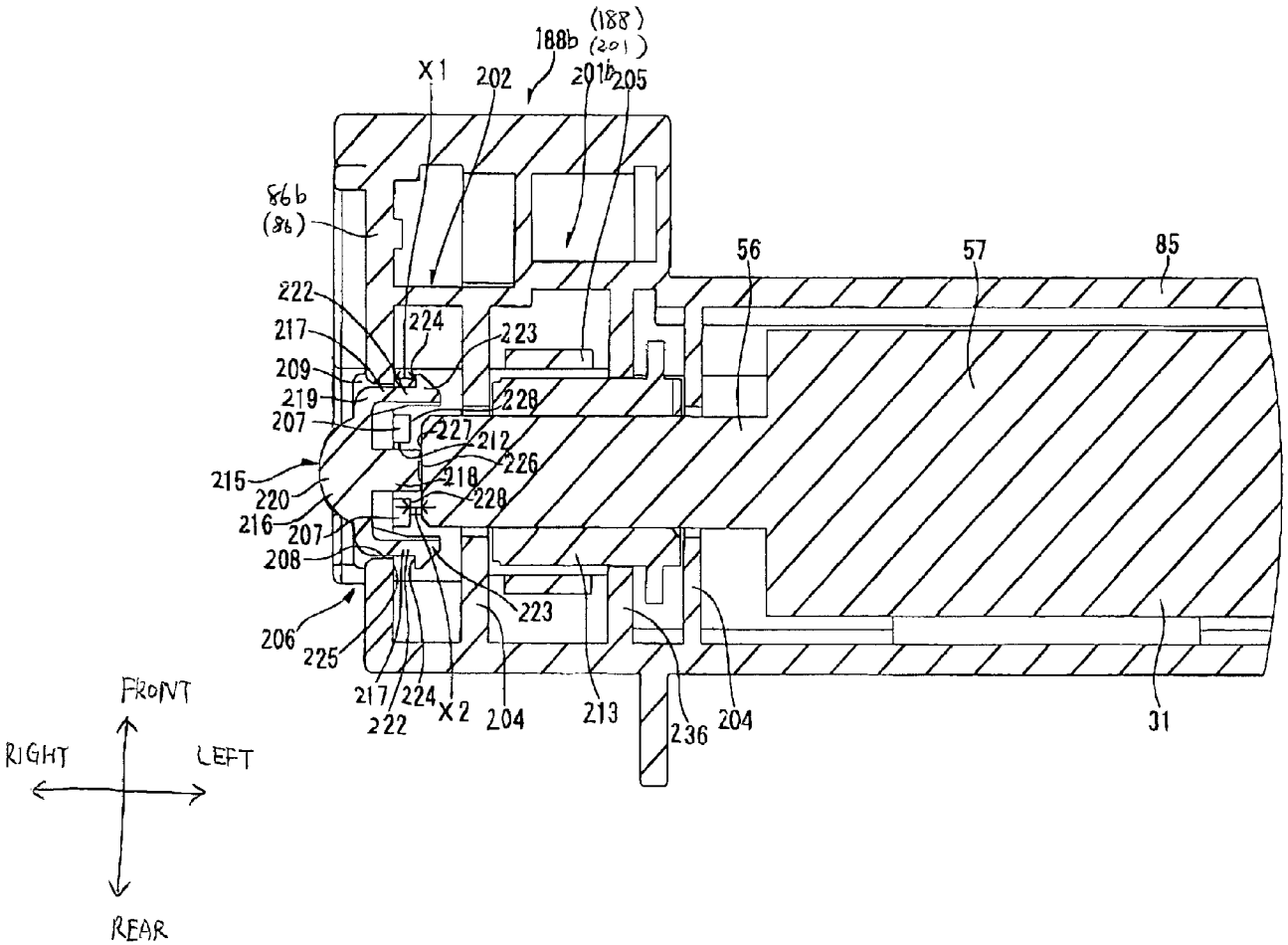
FIG. 9 is an enlarged cross-sectional view of an essential part of the drum cartridge in FIG. 3.
Figure 10:
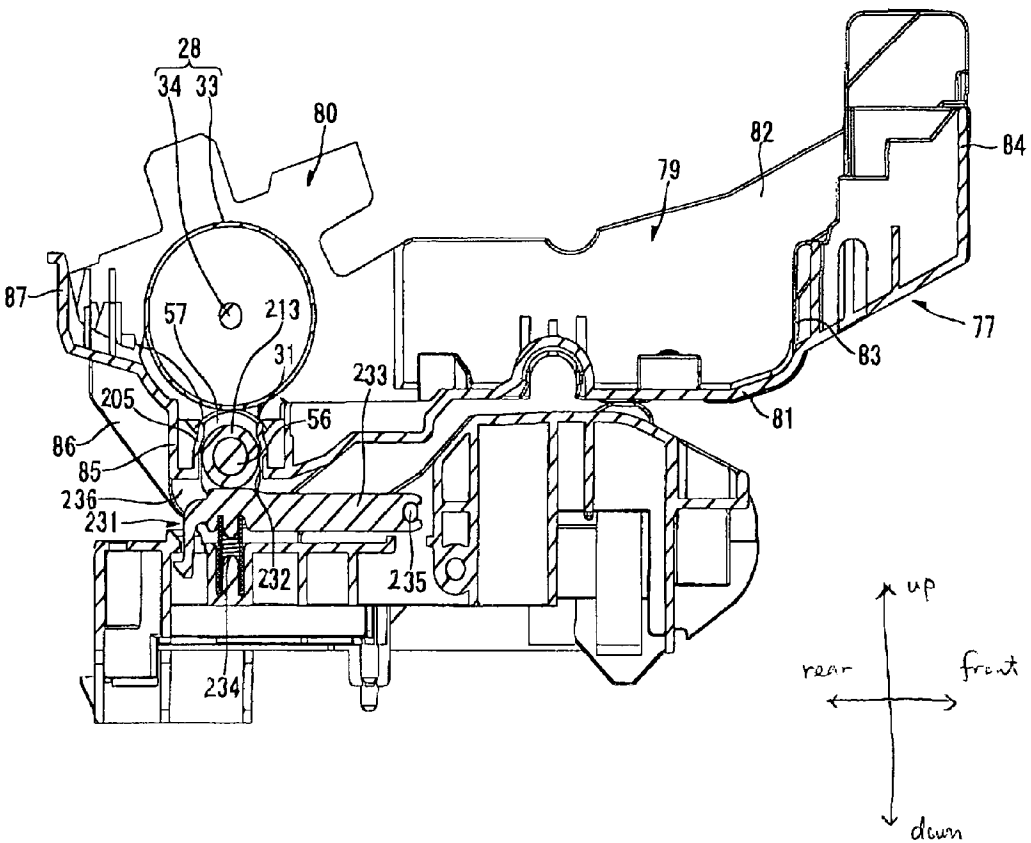
FIG. 10 is a side cross-sectional view illustrating the drum cartridge in FIG. 6 mounted in the main casing of the laser printer.
Figure 11:
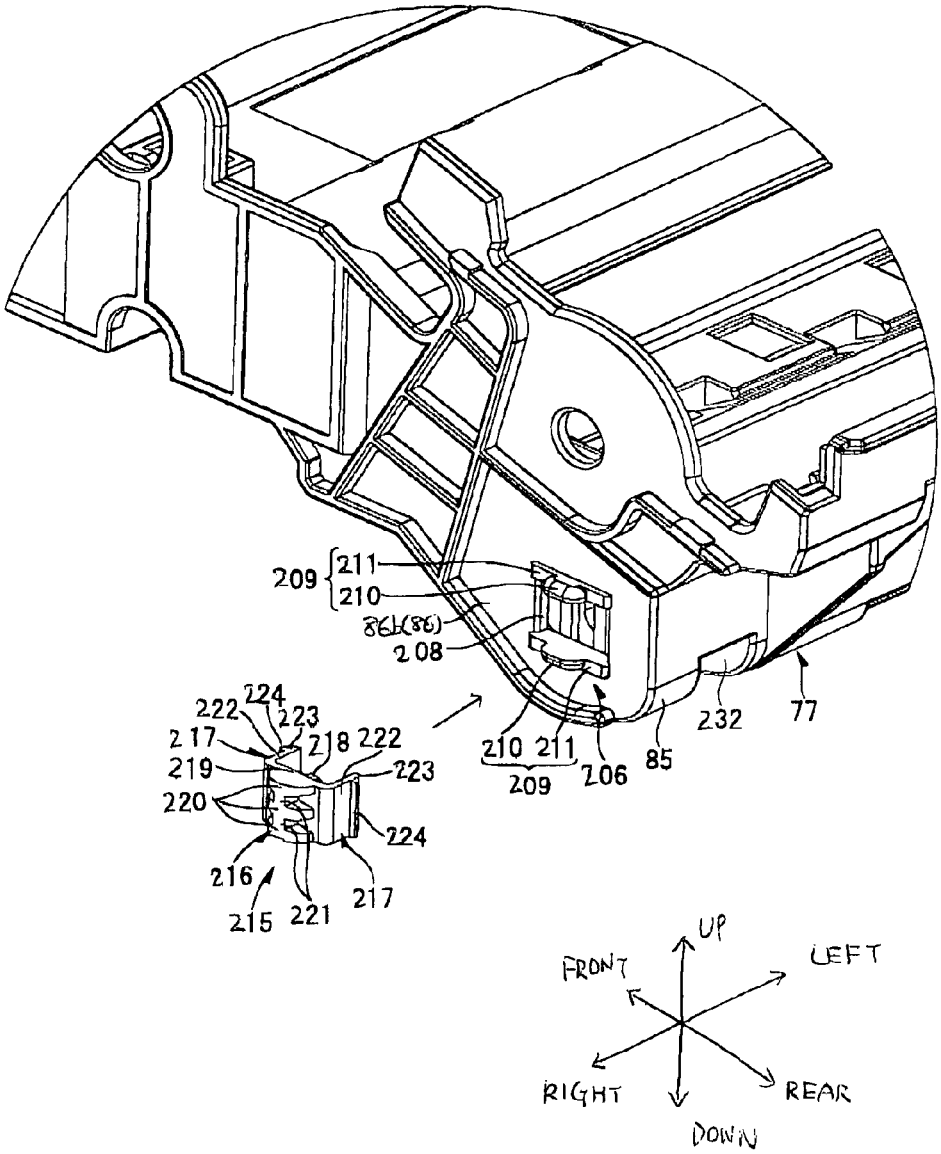
FIG. 11 is a perspective view illustrating the process for mounting an electrode member.

FIG. 6 is a perspective view of the drum cartridge 27 from above the rear side thereof. FIG. 7 is a plan view of the drum cartridge 27, omitting an upper casing 78 and the photosensitive drum 28. FIG. 8 is a horizontal cross-sectional view of the drum cartridge 27 in FIG. 7 taken along the center axis of the transfer roller 31. FIG. 9 is an enlarged cross-sectional view of an essential part (right-side part) of the drum cartridge 27 in FIG. 8. FIG. 10 is a side cross-sectional view illustrating the drum cartridge 27 in FIG. 6 mounted in the main casing 2 of the laser printer 1. FIG. 11 is a perspective view illustrating the process for mounting the electrode member 215.

Next, detailed description will be given for the drum casing 76 of the drum cartridge 27 and the transfer roller 31 provided in the drum casing 76 with reference to FIG. 2 through FIG. 11.

(1) Structure of the Drum Casing

As shown in FIG. 4 and 6, the drum casing 76 includes a lower casing 77, and the upper casing 78 formed separately from the lower casing 77 and assembled on top of the same.

(i) Lower Casing and Transfer Roller

As shown in FIG. 7, the lower casing 77 is integrally provided with a developer cartridge mounting unit 79 disposed on the front side thereof for receiving the developer cartridge 30, and a drum support unit 80 disposed on the rear side thereof and positioned to vertically confront the upper casing 78.

As shown in FIG. 4 and FIG. 7, the developer cartridge mounting unit 79 is integrally provided with a front bottom wall 81 having substantially a rectangular plate shape for receiving the developer cartridge 30 thereon, two front side walls 82 disposed at each widthwise end of the front bottom wall 81 and opposing each other across the width of the front bottom wall 81, and a lower front wall 83 disposed on the front end of the front bottom wall 81. The developer cartridge mounting unit 79 is formed in a frame shape having a bottom and an open top. As shown in FIG. 6, a handle 84 is formed in a widthwise center region of the lower front wall 83 for gripping the drum cartridge 27 when mounting or removing the same.

As shown in FIG. 4 and FIG. 7, the drum support unit 80 is integrally provided with a rear bottom wall 85 having a curved shape on the bottom thereof for receiving the transfer roller 31, two lower rear side walls 86 (a lower rear left-side wall 86*a* and a lower rear right-side wall 86*b*) disposed on widthwise ends of the rear bottom wall 85 and opposing each other across the width of the rear bottom wall 85, and a lower rear wall 87 disposed on the rear edge of the rear bottom wall 85. The drum support unit 80 is formed in a frame shape having a bottom and an open top.

The front end of the rear bottom wall 85 is formed continuously with the rear edge of the front bottom wall 81. As shown in FIG. 4, the rear bottom wall 85 is shaped sagging downward in the center from the front edge to the rear edge so as to be substantially fan-shaped in a side view.

Two lower rear side walls 86 are bent to be erected vertically from the widthwise edges of the rear bottom wall 85. Through-holes (not shown) are formed in the lower rear side walls 86 at positions opposing each other in the width direction for inserting the drum shaft 34 of the photosensitive drum 28.

The lower rear wall 87 is formed continuously from the rear edge of the rear bottom wall 85 across the entire width between the lower rear side walls 86. The lower rear wall 87 is an elongated rectangular plate in a front view that is erected vertically and extends in the width direction. As shown in FIG. 4, a receiving plate 190 is formed continuously with the lower rear wall 87, extending from the bottom edge of the lower rear wall 87 formed in a slightly downward slope. The receiving plate 190 serves to position the cleaning member 32.

As shown in FIG. 7, transfer roller support units 188 (left-side transfer roller support unit 188*a* and right-side transfer roller support unit 188*b*) are formed on widthwise ends of the drum support unit 80 for supporting the transfer roller 31 in a loosely fitted state. As shown in FIG. 8, the left-side transfer roller support unit 188*a* includes a left-side shaft support unit 201*a* disposed on the left-side widthwise end of the rear bottom wall 85; and a shaft contact part 203 disposed on the outer widthwise side of the left-side shaft support unit 201*a*. The right-side transfer roller support unit 188*b* includes: a right-side shaft support unit 201*b* disposed on the right-side widthwise end of the rear bottom wall 85; and an electrode mounting part 202 disposed on the outer widthwise side of the right-side shaft support unit 201*b*. The left-side and right-side shaft support units 201*a* and 201*b* will be collectively referred to as shaft support units 201 hereinafter.

Each shaft support unit 201 (201*a*, 201*b*) includes bearing plates 204 for receiving the roller shaft 56 of the transfer roller 31, a collar-receiving plate 236 for receiving a collar 213 described later that is provided on the roller shaft 56, and an upper restricting part 205 (see FIG. 10) for restricting upward movement of the transfer roller 31.

As shown in FIG. 8 and FIG. 9, two bearing plates 204 spaced apart are disposed on a widthwise inner side and outer side on each end of the roller shaft 56 protruding from the roller 57 of the transfer roller 31. Each bearing plate 204 is substantially U-shaped in a side view (not shown) and extends vertically with an opening formed in the top. The opening in the U-shaped bearing plates 204 is slightly wider than the diameter of the roller shaft 56.

The collar-receiving plate 236 is disposed between the pair of bearing plates 204 on each end. As shown in FIG. 10, each collar-receiving plate 236 is substantially U-shaped in a side view (the view in FIG. 10) and extends vertically with an opening formed in the top. The opening in the U-shaped collar-receiving plate 236 is slightly wider than the collar 213.

As shown in FIG. 8 and FIG. 9, the upper restricting part 205 is disposed between the collar-receiving plate 236 and the bearing plate 204 of the widthwise outer side on each end. As shown in FIG. 10, the upper restricting part 205 opposes the collar 213 from both sides so as to grip the collar 213. The upper restricting part 205 is bent inward in the opposing direction so as to decrease the opposing distance as the upper restricting part 205 extends upward. The opposing distance between upper ends of the upper restricting part 205 is narrower than the diameter of the collar 213.

As shown in FIG. 10 and FIG. 11, opening 232 are formed in the bottom rear wall 85 beneath the upper restricting parts 205 and penetrate the lower casing 77 vertically.

As shown in FIG. 9, the electrode mounting part 202 is disposed on the outer widthwise side of the right-side shaft support unit 201*b* and includes an electrode insertion part 206, and a side restricting part 207.

As shown in FIG. 11, the electrode insertion part 206 is configured of an insertion opening part 208, which is an opening formed in the lower rear right-side wall 86*b* at a position opposing the transfer roller 31 in the width direction; and expanding parts 209 disposed on opposing vertical sides of the insertion opening part 208.

The insertion opening part 208 formed in the lower rear right-side wall 86*b* is substantially rectangular in shape, having a front-to-rear length (width) greater than the distance between outside surfaces of opposing side plates 222 of engaging parts 217 for the electrode member 215 described later and smaller than a distance between outside protruding edges of engaging surfaces 224 formed on pawls 223 of the electrode member 215. The vertical length (height) of the insertion opening part 208 is substantially greater than the vertical length of the electrode member 215.

Each expanding part 209 is configured of a center expanding part 210 that expands in substantially a fan shape from a front-to-rear center region of the insertion opening part 208 in a direction outward from the lower rear right-side wall 86*b* in the width direction; and side expansion parts 211 that are raised protrusions expanding less than the center expanding part 210 on both front to rear sides of the center expanding part 210.

As shown in FIG. 9, the side restricting part 207 is disposed in proximity of the insertion opening part 208 between the insertion opening part 208 and the outermost bearing plate 204 in the width direction. The side restricting part 207 is plate-shaped and extends from the rear bottom wall 85. The side restricting part 207 has a smaller front-to-rear length (width) than the width of the insertion opening part 208 and is disposed within a projected surface of the insertion opening part 208 in the width direction. Specifically, the side restricting part 207 is disposed so that gaps are formed between the front edge of the side restricting part 207 and the front edge of the insertion opening part 208 large enough to insert the engaging parts 217 of the electrode member 215. An insertion through-hole 212 is also formed in the front-to-rear center of the side restricting part 207 for inserting a contact part 218 of the electrode member 215.

As will be described later, a widthwise inner surface of the side restricting part 207 forms a restricting surface 228 that opposes and is capable of contacting an axial endface 227 of the roller shaft 56 when the transfer roller 31 is mounted in the lower casing 77.

As shown in FIG. 8, the shaft contact part 203 is disposed on an outer widthwise end of the left-side shaft support unit 201*a* and is formed in a plate shape extending from the rear bottom wall 85. The shaft contact part 203 confronts the outer bearing plate 204 in the width direction at a distance (a gap for interposing a transfer roller gear 214 described later).

The drum casing 76 is formed by first mounting the transfer roller 31 and the electrode member 215 in the lower casing 77 and subsequently mounting the photosensitive drum 28 in the lower casing 77 and the upper casing 78 on the lower casing 77.

(ii) Mounting the Transfer Roller

In order to mount the transfer roller 31 in the lower casing 77, first the collars 213 are mounted on both ends of the roller shaft 56 for the transfer roller 31. Next, the transfer roller gear 214 is mounted on the left-side end of the roller shaft 56.

As shown in FIG. 8, the inner surface of the collar 213 is cylindrical in shape and substantially equivalent to the peripheral surface of the roller shaft 56. The length of the collar 213 in the axial direction is substantially equivalent to (or slightly shorter than) the gap between the two bearing plates 204. The collars 213 are fitted over both ends of the roller shaft 56.

The transfer roller gear 214 is shaped so as to cover the outer peripheral surface of the roller shaft 56 and the left-side axial endface 229 of the roller shaft 56. The transfer roller gear 214 is mounted on the left-side end of the roller shaft 56 so as to be incapable of rotating relative to the roller shaft 56.

Next, the transfer roller 31 is placed in the lower casing 77 so that both ends of the roller shaft 56 rest in the corresponding shaft support units 201.

When the roller shaft 56 of the transfer roller 31 is placed on the shaft support units 201, each end of the roller shaft 56 is received by two bearing plates 204 positioned on widthwise inside and outside portions of the end of the roller shaft 56. Further, each collar 213 is received in the collar-receiving plate 236 and accommodated between the two bearing plates 204. The collar 213 is also gripped by the upper restricting part 205. The transfer roller gear 214 is accommodated between the shaft contact part 203 and the widthwise outside bearing plate 204 on the left-side shaft support unit 201*a*.

When mounted in this way, the transfer roller 31 is in a loosely fitted state prior to mounting the drum cartridge 27 in the main casing 2 and can be moved freely up and down or slid in the width direction.

More specifically, the roller shaft 56 is free to move one way (rightwardly) in the width direction until the axial endface 227 on the right-side and thereof contacts the restricting surface 228 of the side restricting part 207, as shown in FIG. 9, and can move the outer way (leftwardly) in the width direction until the axial endface 229 formed on the left-side end of the roller shaft 56 contacts the shaft contact part 203 via the transfer roller gear 214. In this way, the transfer roller 31 is loosely fitted so as to be able to slide in the width direction.

As shown in FIG. 10, the transfer roller 31 is also loosely fitted with respect to the vertical direction. Specifically, the transfer roller 31 is capable of moving downward until the ends of the roller shaft 56 are received in the bearing plates 204 and the collars 213 are received in the collar-receiving plates 236, and is capable of moving upward until the collars 213 become pinched between the upper restricting parts 205.

As shown in FIG. 9 and FIG. 11, the electrode member 215 is mounted on the lower rear right-side wall 86*b* of the lower casing 77 for supplying a transfer bias to the transfer roller 31.

As shown in FIG. 9 and FIG. 11, the electrode member 215 is shaped substantially like the letter E in a plan view. The electrode member 215 is formed of an electrically conductive resin that integrally includes a base end 216 that is urged by the power-feeding member 230 described later, the engaging parts 217 for engaging with the lower rear right-side wall 86*b*, and the contact part 218 for contacting the axial endface 227 of the roller shaft 56.

The base end 216 includes a base plate 219 formed as a substantially rectangular plate, and expanding contact parts 220 that expand outward in the width direction substantially in the shape of a fan. The expanding contact parts 220 are configured of three parts spaced at intervals in the vertical direction and are linked together by a protrusion 221 formed along the vertical.

The engaging parts 217 include two side plates 222 that extend inward in the width direction from front and rear sides of the base end 216 so as to be positioned opposite each other, and the pawls 223 disposed on the side plates 222.

The side plates 222 are substantially rectangular and plate-shaped and extend parallel to each other from the front and rear edges of the base end 216.

The pawls 223 are disposed on the inside ends of the side plates 222 with respect to the width direction and are formed in hook shapes that protrude outward from the side plates 222 in the front-to-rear direction. End faces on the widthwise outer sides of the pawls 223 constitute engaging surfaces 224 for engaging with an inner surface 225 of the lower rear right-side wall 86*b* formed on the front and rear edges of the insertion opening part 208.

The contact part 218 has a substantially thick rectangular plate shape and extends inward in the width direction from the front-to-rear center of the base end 216 interposed between the engaging parts 217 with a gap 218 extends parallel to the engaging parts 217 with a gap formed therebetween. The widthwise length of the contact part 218 is shorter than that of the engaging parts 217. An endface on the widthwise inside of the contact part 218 constitutes a contact surface 226 for contacting the axial endface 227 of the roller shaft 56 at an axial center (rotational center) of the roller shaft 56.

The electrode member 215 is mounted on the lower rear right-side wall 86*b* as follows.

First, the pawls 223 of the engaging parts 217 are pressed inward so that the engaging parts 217 bend inward in the opposing direction of the side plates 222. At this time, the distance between outer edges of the opposing pawls 223 is less than the width of the insertion opening part 208 formed in the lower rear right-side wall 86*b*.

Next, the engaging parts 217 and contact part 218 of the electrode member 215 are inserted inward in the width direction into the lower rear right-side wall 86*b* via the insertion opening part 208 from the widthwise outer side of the lower rear right-side wall 86*b*, as indicated by the arrow in FIG. 11, after which the pressure on the pawls 223 is released. At this time, as shown in FIG. 9, the side plate 222 of the engaging part 217 on the front side of the electrode member 215 is interposed between the front edge of the insertion opening part 208 and the front edge of the side restricting part 207, and the side plate 222 of the engaging part 217 on the rear side of the electrode member 215 is interposed between the rear edge of the insertion opening part 208 and the rear edge of the side restricting part 207. Further, the pawls 223 of the engaging parts 217 are disposed such that the engaging surfaces 224 formed on the pawls 223 are positioned opposite and are capable of engaging with the inner surface 225 of the lower rear right-side wall 86*b* at the front and rear edges of the insertion opening part 208. Further, the contact part 218 is inserted through the insertion through-hole 212 formed in the side restricting part 207 so that the contact surface 226 of the contact part 218 opposes and is capable of contacting the axial endface 227 of the roller shaft 56 at the axial center (rotational center) thereof.

Further, the base plate 219 of the base end 216 conform with the side expansion parts 211 of the expanding parts 209, the expanding contact parts 220 conform with the center expanding parts 210 of the expanding parts 209, and the expanding contact parts 220 and protrusion 221 are exposed from the widthwise outer side of the lower rear right-side wall 86*b*.

Mounted in this way, the electrode member 215 is loosely fitted in the lower rear right-side wall 86*b* and is capable of sliding in the width direction with respect to the lower rear right-side wall 86*b* before the drum cartridge 27 is mounted in the main casing 2. The electrode member 215 is thus slidably mounted in the lower rear right-side wall 86*b*, and is detachable from the lower rear right-side wall 86*b*.

Separately, the electrode member 215 is accommodated so as to be able to move one way (rightwardly) in the width direction until the engaging surfaces 224 of the pawls 223 engage with the inner surface 225 of the lower rear right-side wall 86*b* on the front and rear edges of the insertion opening part 208, and to be able to move the other way (leftwardly) in the width direction until the same plate 219 of the base end 216 contacts the side restricting part 207.

When the electrode member 215 is mounted in the lower rear right-side wall 86*b* in this way, the side restricting part 207 is positioned between the base end 216 and the axial endface 227 of the roller shaft 56 with respect to the width direction. The restricting surface 228 of the side restricting part 207 restricts the roller shaft 56 from moving one way (rightwardly) in the width direction, preventing the axial endface 227 of the roller shaft 56 from contacting the base end 216.

More specifically, the drum cartridge 27 is configured so that when the drum cartridge 27 is mounted in the main casing 2 and the transfer roller 31 is positioned in the width direction (axial direction), as will be described later, a distance X1 between the engaging surfaces 224 of the pawls 223 and the inner surface 225 of the right side wall 86*b* on the front and rear edges of the insertion opening part 208 is greater than a distance X2 between the restricting surface 228 of the side restricting part 207 and the axial endface 227 of the roller shaft 56.

(iii) Upper Casing, Clearing Member, and Grits

Figure 12:
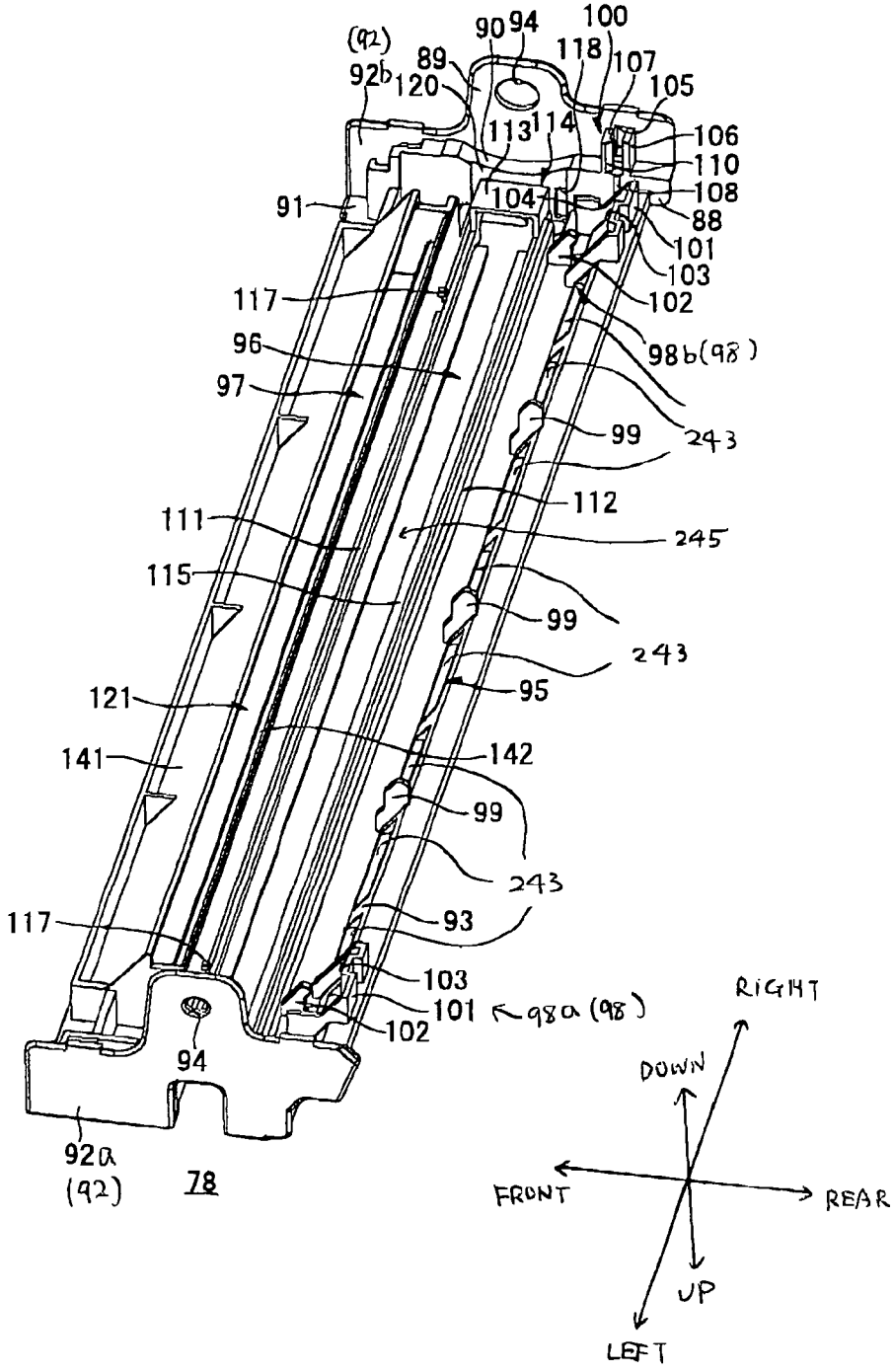
FIG. 12 is a perspective view showing an upper casing of the drum cartridge in FIG. 6 from the bottom side, prior to mounting a cleaning terminal and a cleaning member.
Figure 13:
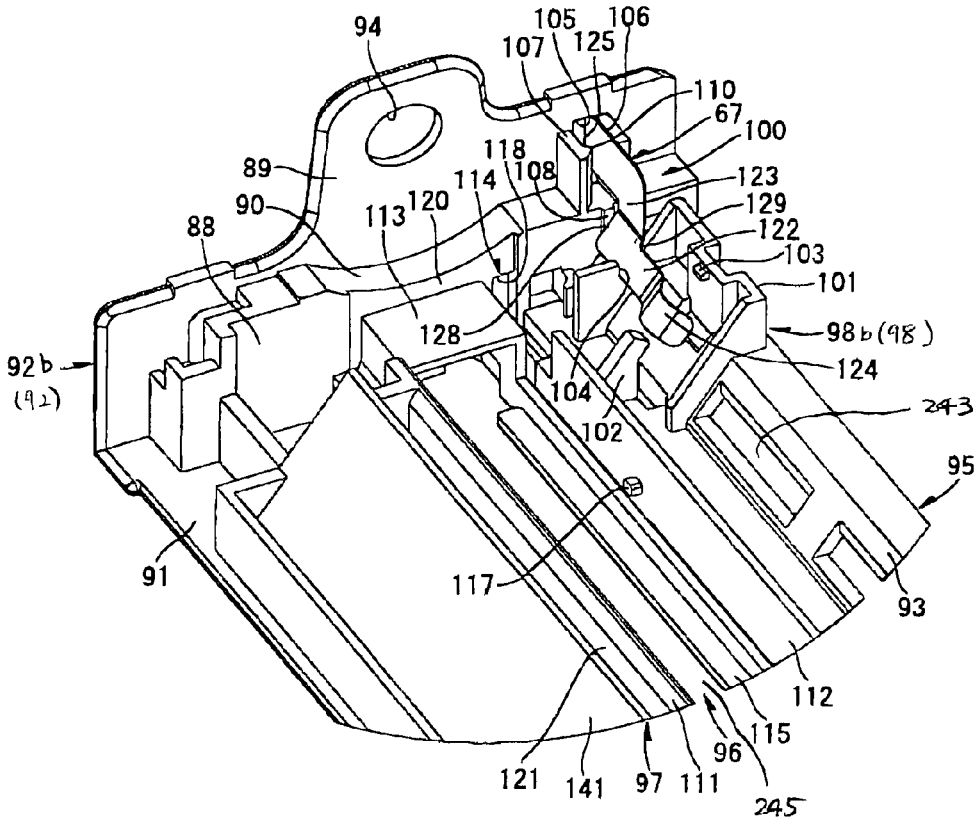
FIG. 13 is a perspective view showing part of the upper casing in FIG. 12 from the bottom side, after mounting the cleaning terminal and prior to mounting the cleaning member.
Figure 13:
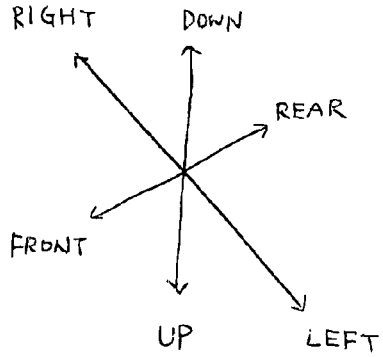
Figure 14:
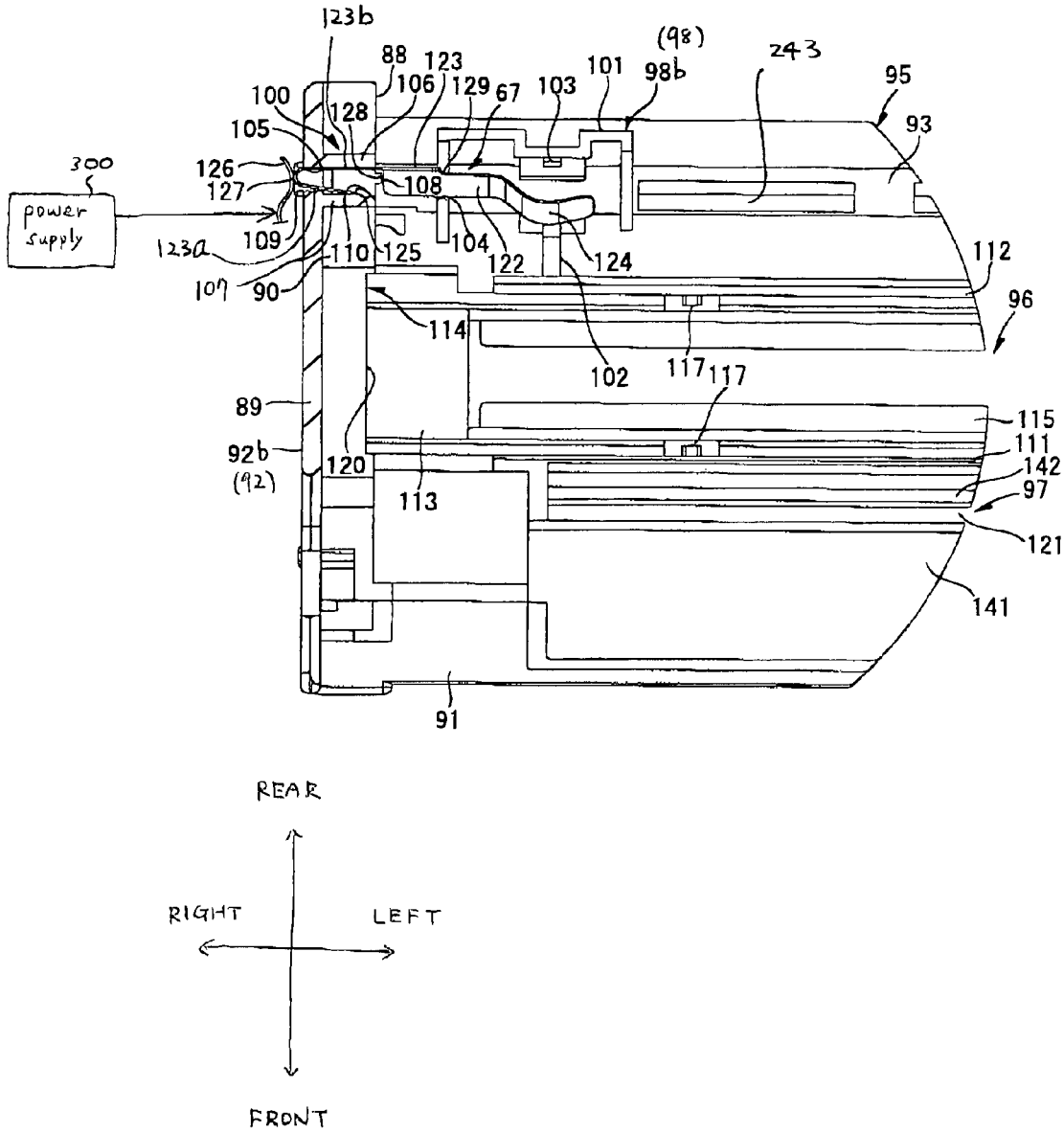
FIG. 14 is a partial horizontal cross-sectional and bottom view of the portion of the upper casing in FIG. 13.
Figure 15:
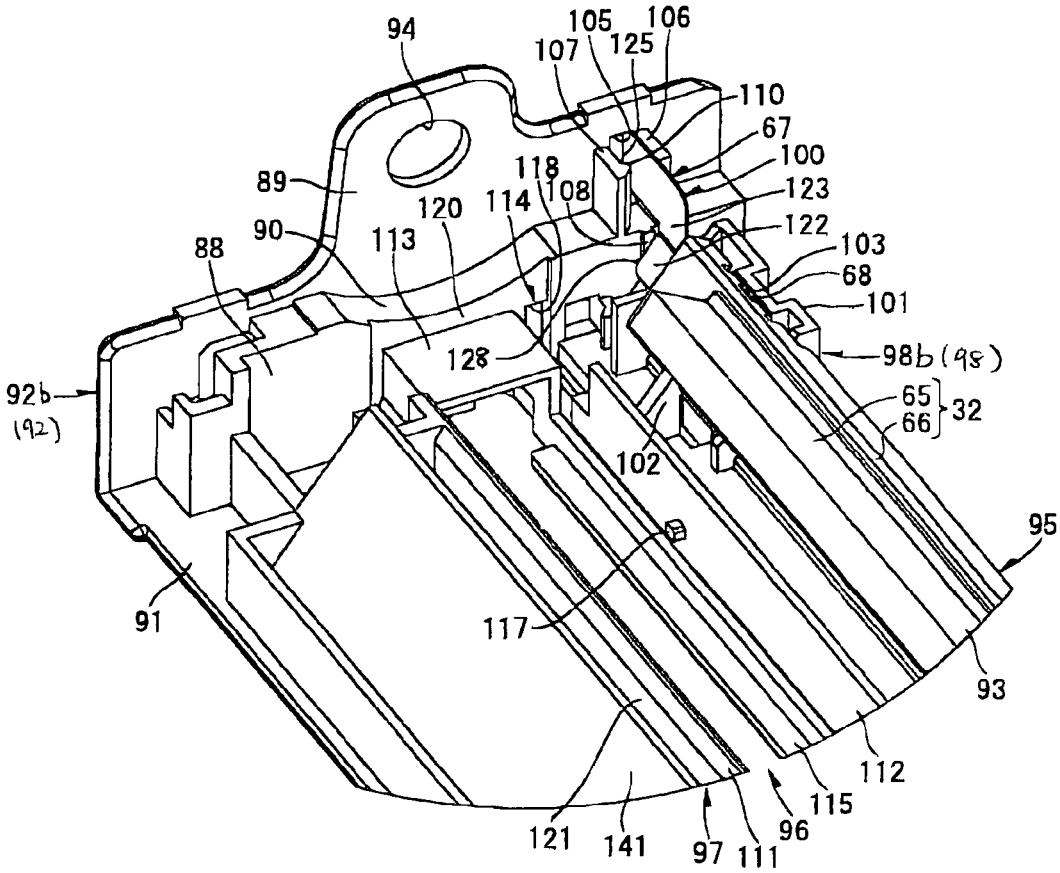
FIG. 15 is a perspective view showing part of the upper casing in FIG. 12 from the bottom side, after both the cleaning terminal and the cleaning member have been mounted.
Figure 15:
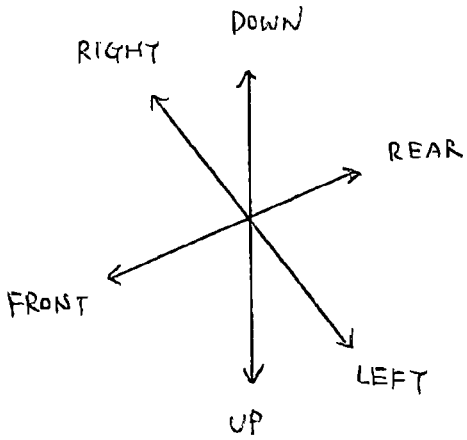
Figure 16:
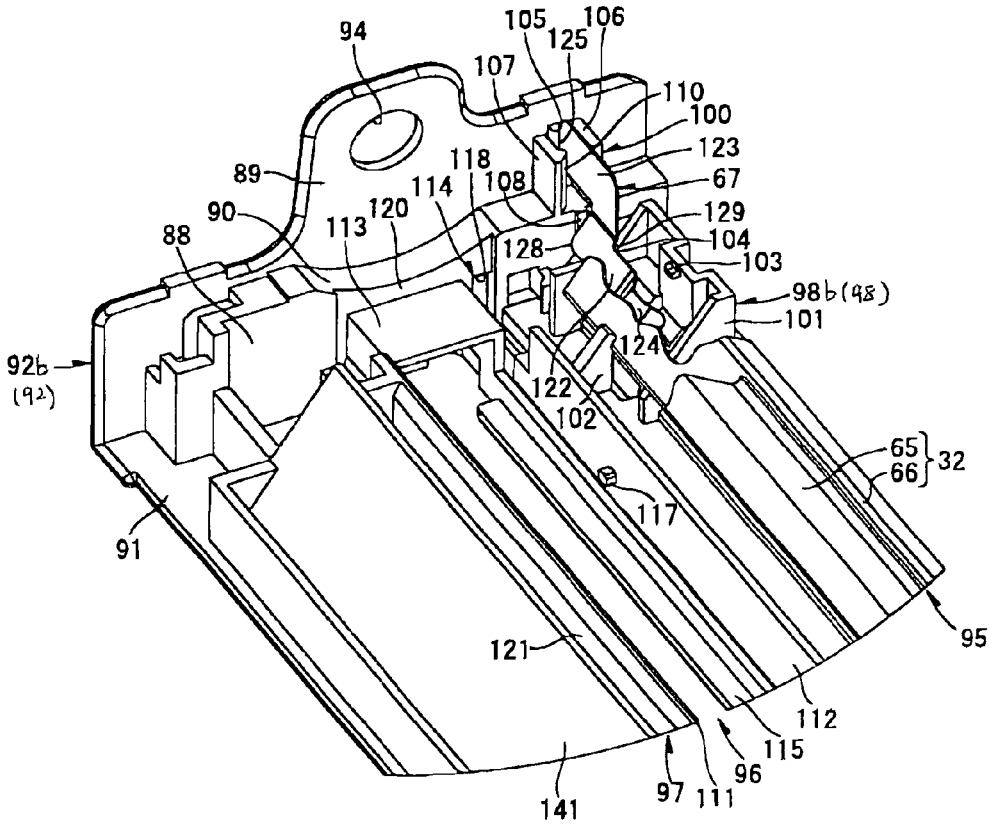
FIG. 16 is a perspective view corresponding to the upper casing shown in FIG. 15 with a portion cut away.
Figure 16:
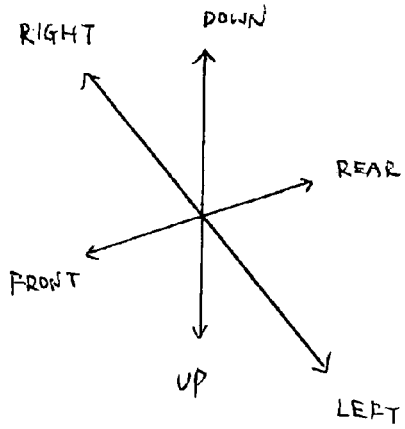
Figure 17:
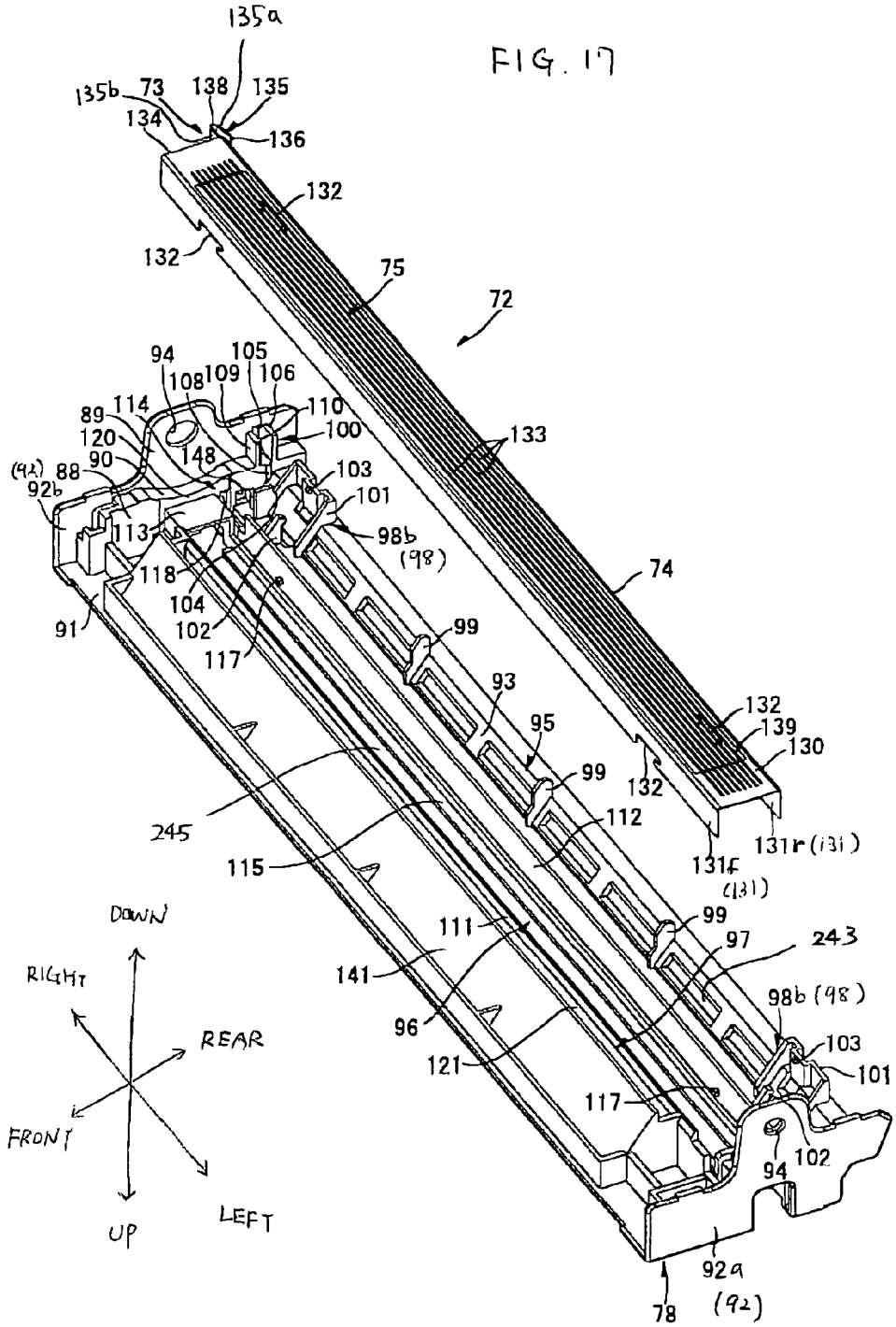
FIG. 17 is a perspective view of the upper casing in FIG. 12 from the bottom side, prior to mounting a grid.
Figure 18:
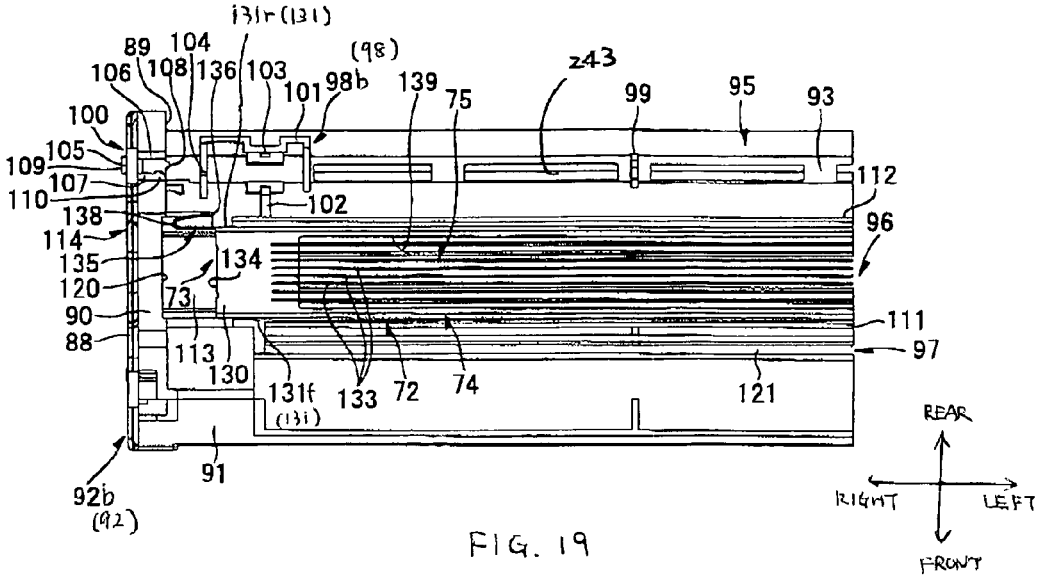
FIG. 18 is a bottom view of part of the upper casing during assembly of the grid.
Figure 19:
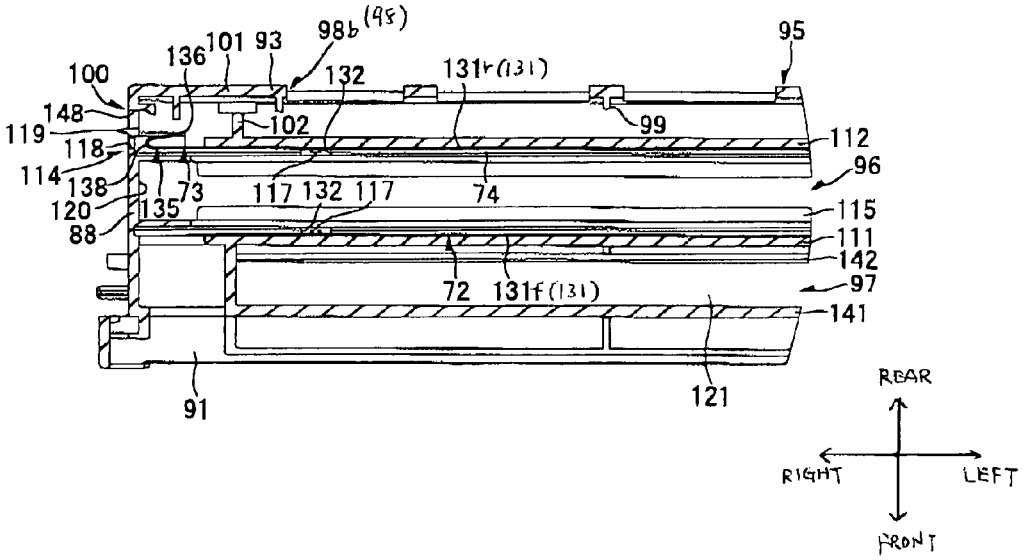
FIG. 19 is a horizontal cross-sectional view corresponding to the part shown in FIG. 18.
Figure 20:
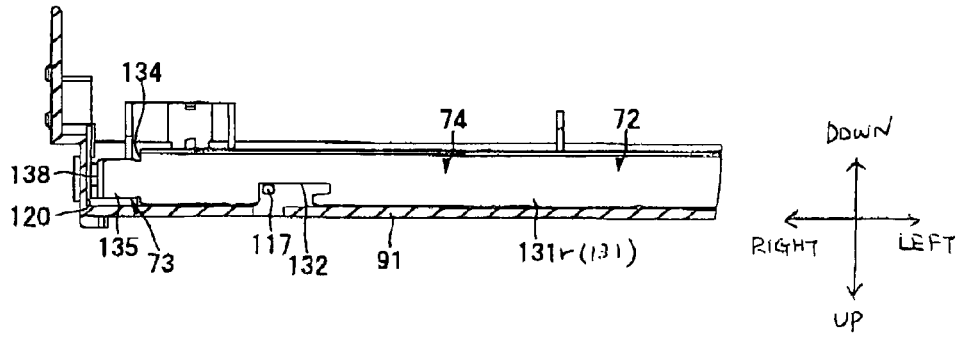
FIG. 20 is a vertical cross-sectional view corresponding to the part shown in FIG. 18.
Figure 21:
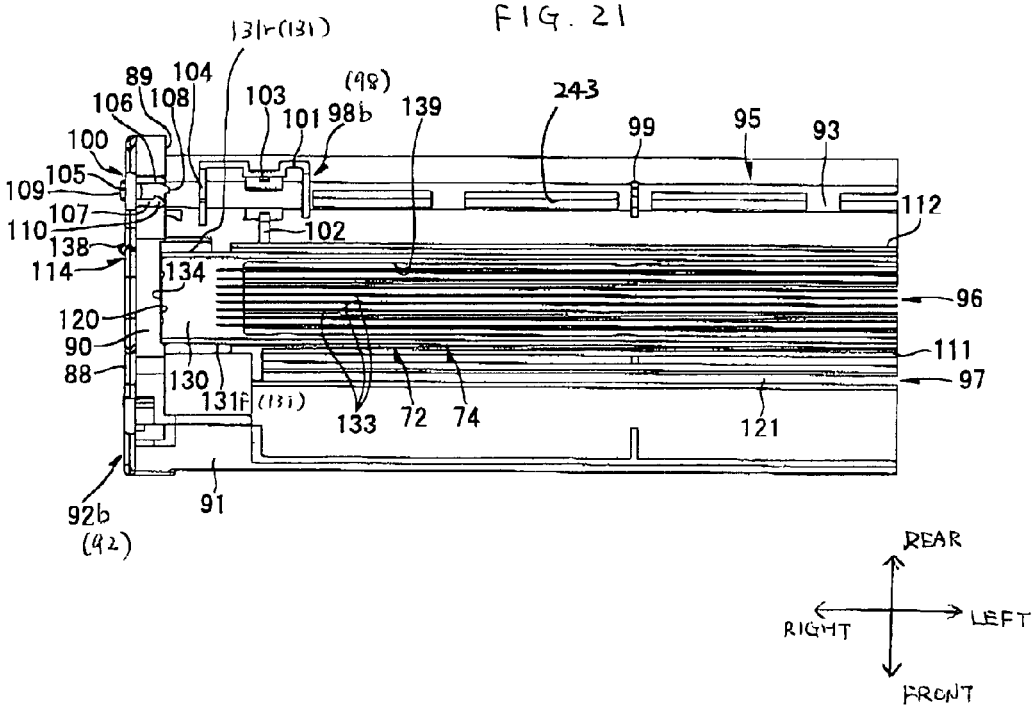
FIG. 21 is a bottom view of part of the upper casing when the grid has been mounted thereon.
Figure 22:
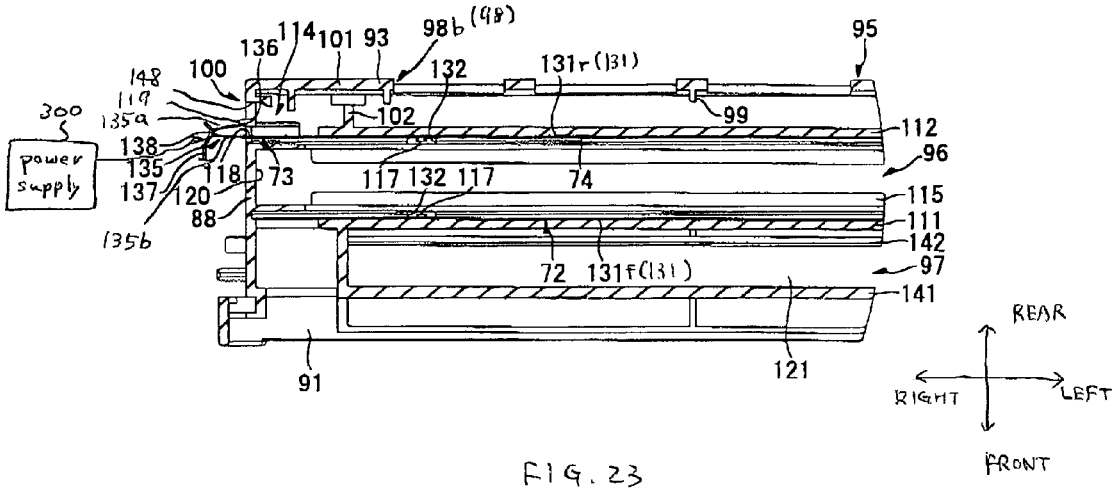
FIG. 22 is a horizontal cross-sectional view corresponding to the part shown in FIG. 21.
Figure 23:
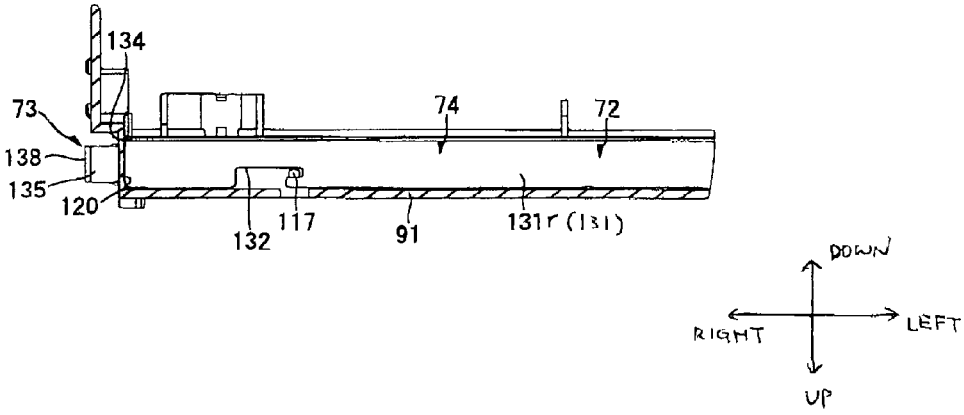
FIG. 23 is a vertical cross-sectional view corresponding to the part shown in FIG. 21.
Figure 24:
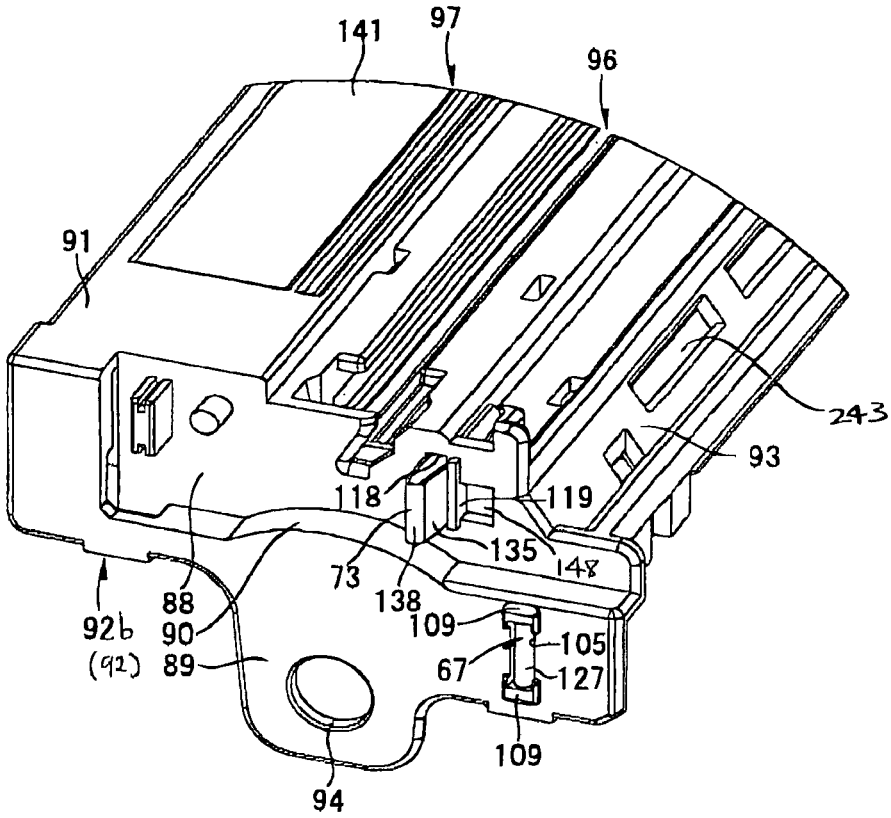
FIG. 24 is a perspective view of part of the upper casing in FIG. 12 from the top side when the grid and the cleaning member have been mounted thereon.
Figure 24:
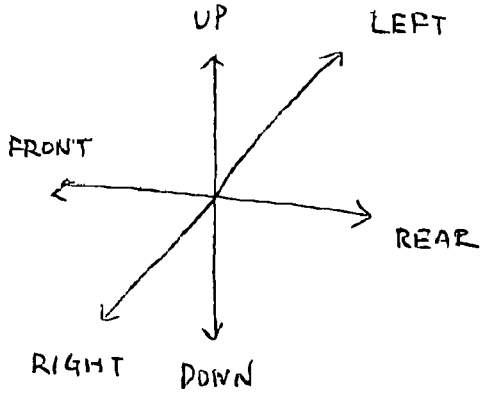
Figure 25:
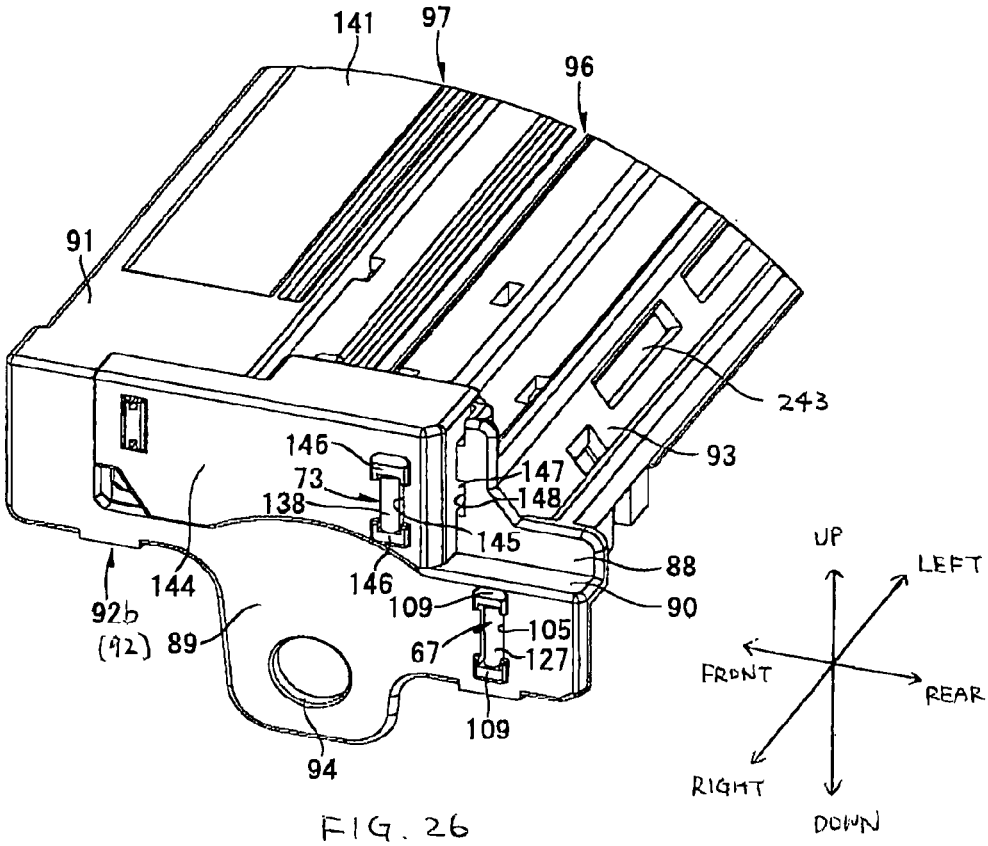
FIG. 25 is a perspective view of the upper casing shown in FIG. 24 from the top side when a grid terminal cover has been mounted.
Figure 26:
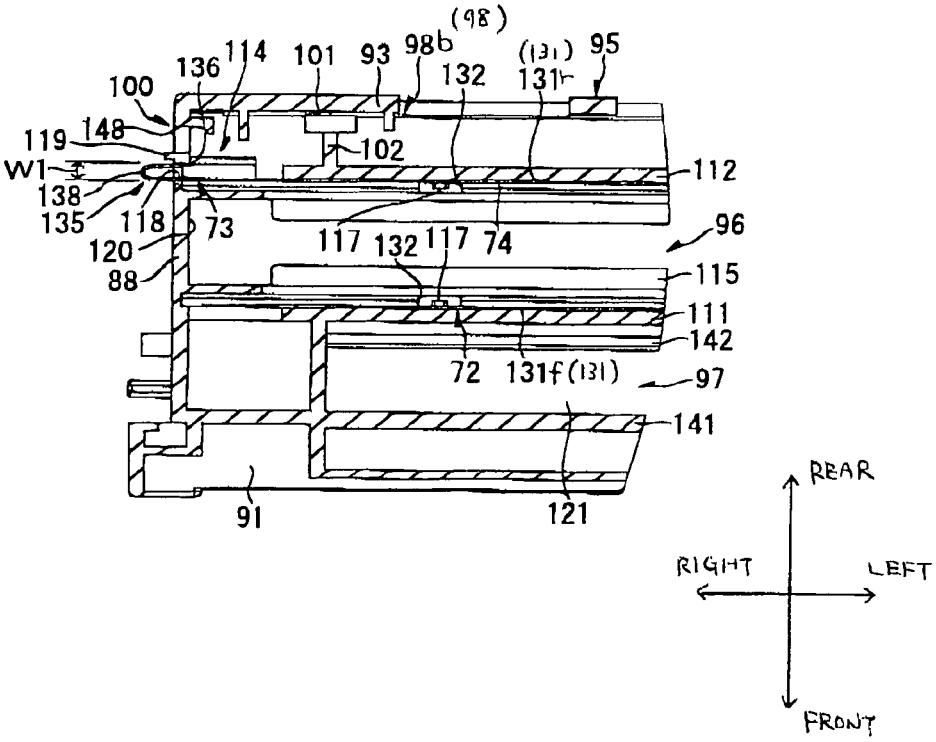
FIG. 26 is a horizontal cross-sectional view of part of the upper casing when the grid is in a state between the not completely mounted state in FIG. 19 and the completely mounted state in FIG. 22.

FIG. 12 is a perspective view showing the upper casing 78 of the drum cartridge 27 from the bottom side, prior to mounting the cleaning terminal 67 and the cleaning member 32. FIG. 13 is a perspective view showing part (right-side part) of the upper casing 78 from the bottom side, after mounting the cleaning terminal 67 and prior to mounting the cleaning member 32. FIG. 14 is a partial horizontal cross-sectional and bottom view of the portion (right-side portion) of the upper casing 78. FIG. 15 is a perspective view showing part (right-side part) of the upper casing 78 from a bottom, after both the cleaning terminal 67 and the cleaning member 32 have been mounted. FIG. 16 is a perspective view corresponding to the upper casing 78 shown in FIG. 15 with a portion cut away. FIG. 17 is a perspective view of the upper casing 78 from the bottom side, prior to mounting the grid 72. FIG. 18 is a bottom view of the upper casing 78 during assembly of the grid 72. FIG. 19 is a horizontal cross-sectional view corresponding to the part shown in FIG. 18. FIG. 20 is a vertical cross-sectional view corresponding to the part shown in FIG. 18. FIG. 21 is a bottom view of the upper casing 78 when the grid 72 has been mounted thereon. FIG. 22 is a horizontal cross-sectional view corresponding to the part shown in FIG. 21. FIG. 23 is a vertical cross-sectional view corresponding to the part shown in FIG. 21. FIG. 24 is a perspective view of a part (right-side part) of the upper casing 78 from the top side when the grid 72 and the cleaning member 32 have been mounted on the upper casing 78. FIG. 25 is a perspective view of the part (right-side part) of the upper casing 78 shown in FIG. 24 from the top side when a grid terminal cover 144 has been mounted. FIG. 26 is a horizontal cross-sectional view of the upper casing 78 when the grid 72 is in a state between the not completely mounted state in FIG. 19 and the mounted state in FIG. 22. It is noted that in FIGS. 12-26, the discharge wire 72 is omitted for clarity purposes.

Next, detailed description will be given for the upper casing 78 and assembly of the cleaning member 32 and grid 72 on the upper casing 78 with respect to FIGS. 3-6 and 12-26.

As shown in FIG. 4 and FIG. 12, the upper casing 78 is integrally provided with a top wall 51 having a substantially rectangular plate shape, two upper side walls 92 (an upper left side wall 92*a* and a upper right side wall 92*b*) disposed at both widthwise ends of the top well 91 and opposing each other across the width thereof, and an upper rear wall 93 disposed on the rear edge of the top wall 91. This construction forms a substantially rectangular shape in a front view that is open on the bottom and on the font and rear sides.

The upper side walls 92 are bent downward from the widthwise edges of the top wall 91. Through-holes 94 are formed in both of the upper side walls 92 at positions opposite each other in the width direction. The through-holes 94 accept the insertion of the drum shaft 34 of the photosensitive drum 28. As shown in FIG. 12 and FIG. 24, one of the upper side walls 92 (upper right-side wall 92*b*; has an upper inner wall 88 and a lower outer wall 89 that are formed continuously via a step wall 90.

The upper inner wall 88 has a plate shape that extends vertically so that the upper edge of the upper inner wall 88 is continuous with the top wall 91. The upper inner wall 88 constitutes the upper half of the upper right-side wall 92*b* (excluding the front portion).

The lower outer wall 89 is disposed farther outward than the upper inner wall 88 in the width direction. The lower outer wall 89 has a plate shape extending vertically and constitutes the lower half and the front portion in the upper half of the upper right-side wall 92*b*.

The step wall 90 extends in the width direction and links the lower edge of the upper inner wall 88 with the upper edge of a part of the lower outer wall 89 forming the lower half of the upper right-side wall 92*b*, and the front edge of the upper inner wall 88 with the rear edge of another part of the lower outer wall 89 forming the upper half of the upper right-side wall 92*b*. In this upper right-side wall 92*b*, the through-hole 94 is formed in the front-to-rear center of the lower outer wall 89.

As shown in FIG. 4, the upper rear wall 93 is bent obliquely rearward and downward from the rear edge of the top wall 91 so as to form an obtuse angle with the top wall 91.

As shown in FIG. 3, a protruding part 244 protrudes upward from the top end of the upper rear wall 93 and extends along the width of the upper rear wall 93.

As shown in FIG. 12 and FIG. 17, a cleaning support unit 95 is provided on the rear side of the upper casing 78 for supporting the cleaning member 32. A charger support unit 96 is disposed on the front side of the cleaning support unit 95 for supporting the charger 29. A beam injection unit 97 is disposed on the front side of the charger support unit 96 for allowing passage of a laser beam emitted from the scanning unit 19.

As shown in FIG. 12, the cleaning support unit 95 includes engaging parts 98 (a left-side engaging part 98*a* and a right-side engaging part 98*b*) disposed on both widthwise ends of the top wall 91 and upper rear wall 93 for engaging with the support plate 66 of the cleaning member 32; support pieces 99 disposed between the engaging parts 98; and a cleaning terminal support unit 100 disposed on the upper right-side wall 92*b*.

Each of the engaging parts 98 includes a base part 101 provided on the upper rear wall 93 that, when seen from the bottom, appears as a rectangle with an open front side; and a front pawl 102 that confronts the base part 101 in the front-to-rear direction.

Each of the base parts 101 is integrally configured of opposing side walls and a connecting wall linking the rear edges of the two side walls. The base part 101 is formed to protrude in a direction following the slope of the upper rear wall 93 so that the lower edges of the side walls and the connecting wall can support the support plate 66. A rear pawl 103 is formed on each base part 101 in the widthwise center of the connecting wall at a position opposite the front pawl 102 in the front-to-rear direction.

A cutout part 104 is formed in the side wall on the widthwise outer side of one of the base parts 101 that is located on the right-side widthwise end of the top wall 91 and the upper rear wall 93. The cutout part 104 is for engaging with the cleaning terminal 67 described later.

A plurality of the support pieces 99 is disposed at equal intervals between the engaging parts 98. Each support piece 99 protrudes from an inner wall surface of the upper rear wall 93. A lower edge of each support piece 99 follows the slope of the upper rear wall 93.

A plurality of openings 243 is formed in the upper rear wall 93 at intervals along the width thereof. Each opening 243 has an elongated rectangular shape extending in the width direction, and penetrates the upper rear wall 93 through the thickness thereof.

The cleaning terminal support unit 100 is formed on the upper right-side wall 92*b* opposing the cutout part 104 in the width direction. The cleaning terminal support unit 100 includes a cleaning-member-side opening 105, a guide plate 106, a cleaning-member-side return contact part 107, and a cleaning-member-side projection contact part 108.

The cleaning-member-side opening 105 is formed in the lower outer wall 89 rearward of the through-hole 94. The cleaning-member-side opening 105 has an elongated. rectangular shape extending vertically and penetrates the lower outer wall 89 in the thickness direction.

As shown in FIG. 25, cleaning covers 109 are provided on the upper and lower edges of the cleaning-member-side opening 105 on the outer wall surface of the lower outer wall 89 for covering the cleaning terminal 67 from above and below.

As shown in FIG. 12 and FIG. 14, the guide plate 106 is formed in a substantially rectangular plate shape on the inner wall surface of the lower outer wall 89 so as to protrude inward in the width direction from the rear edge of the cleaning-member-side opening 105. The widthwise outer endface of the guide plate 106 is formed continuously with the inner wall surface of the lower outer wall 89, while the upper endface of the guide plate 106 is formed continuously with the inner wall surface of the step wall 90. The guide plate 106 extends from the inner wall surface of the lower outer wall 89 in the width direction to a position flush with the inner wall surface of the upper inner wall 88.

The cleaning-member-side return content part 107 is formed substantially in a rectangular plate shape on the inner wall surface of the lower outer wall 89 and extends inward in the width direction from the front edge of the cleaning-member-side opening 105, opposing the guide plate 106 across the cleaning-member-side opening 108 in the front-to-rear direction. The widthwise outer endface of the cleaning-member-side return contact part 107 is formed continuously with the inner wall surface of the lower outer wall 89, and the upper endface of the cleaning-member-side return contact part 107 is formed continuously with the inner wall surface of the step wall 90. The cleaning-member-side return contact part 107 extends from the inner wall surface of the lower outer wall 89 in the width direction to a position flush with the inner wall surface of the upper inner wall 88. Further, a return-restricting pawl 110 is formed on the widthwise inner end of the cleaning-member-side return contact part 107 and expands in a hook shape toward the guide plate 106.

The cleaning-member-side projection contact part 108 is a protrusion that projects inward in the width direction from the inner wall surface of the upper inner wall 88. The cleaning-member-side projection contact part 108 extends vertically on the inner wall surface of the upper inner wall 88 between the guide plate 106 and cleaning-member-side return contact part 107 in the front-to-rear direction. The cleaning-member-side projection contact part 108 is disposed opposite the cutout part 104 of the base part 101 in the width direction and is separated from the cutout part 104 by a gap accommodating a projection-restricting part 128 and a terminal-engaging part 129 of the cleaning terminal 67, which will be described later.

As shown in FIGS. 4, 12 and FIG. 17, the charger support unit 96 includes a front holding plate 111 and a rear holding plate 112 disposed on opposite sides of the grid 72 and opposing each other in the front-to-rear direction; an outer grid fitting part 113 disposed on one widthwise end (right-side end; of the front holding plate 111 and rear holding plate 112; and a grid terminal support part 114 provided on the upper right-side wall 92*b*.

The front holding plate 111 is disposed on the front side of the grid 72 and is formed along the width of the top wall 91, protruding downward from the inner wall surface of the top wall 91.

The rear holding plate 112 is disposed on the rear side of the grid 72 and extends along the width of the top wall 91 parallel to the front holding plate 111, protruding downward from the inner wall surface of the top wall 91.

Although not shown in FIGS. 12-27, in the charger support unit 96, the discharge wire 71 is stretched between the upper left-side wall 92*a* and the upper inner wall 88 in the upper right-side wall 92*b*. As shown in FIG. 6, a charger slot or opening 245 is formed in the top wall 91 between the front holding plate 111 and the rear holding plate 112 above the discharge wire 71 along the width of the charger support unit 96. A cleaner sliding part 115 is defined on the top wall 91 extending along the charge slot 245. A wire cleaner 116 (see FIG. 6) for cleaning the discharge wire 71 is fitted over the cleaner sliding part 115 so as to be capable of sliding in the width direction.

As shown in FIG. 12 and FIG. 17, protrusions 117 are formed on the front holding plate 111 and rear holding plate 112 for fitting into grooves 132 described later that are formed in the grid 72.

The protrusions 117 are formed at corresponding positions on both widthwise ends of the front holding plate 111 and rear holding plate 112 so that corresponding protrusions 117 protrude toward each other from the inner sides of the front holding plate 111 and rear holding plate 112.

The outer grid fitting part 113 is disposed on the right-side widthwise end of the front holding plate 111 and rear holding plate 112. The outer grid fitting part 113 has a cross-sectional shape forming these sides of a rectangle, over which the right-side widthwise end of the grid 72 is fitted over. A right-side widthwise endface of the outer grid fitting part 113 is formed continuously with the inner wall surface of the upper inner wall 88 in the upper right-side wall 92*b*, while the upper endface of the outer grid fitting part 113 is formed continuously with the inner wall surface of the top wall 91. Although not shown in FIGS. 12-27, the right-side end of the discharge wire 71 is attached to the inner side surface of the upper inner wall 98 at a location surrounded by the three sides of outer grid fitting part 113.

The grid terminal support part 114 is formed on the upper inner wall 88 in the upper right-side wall 92*b* and faces the front holding plate 111 and rear holding plate 112 in the width direction. As shown in FIG. 18 and FIG. 24, the grid terminal support part 114 includes a grid-side opening 118, a grid-side return contact part 119, and a grid-side projections contact part 120.

The grid-side opening 118 has an elongated rectangular shape extending vertically and penetrates the thickness of the upper inner wall 88 at a position between the through-hole 94 and the cleaning-member-side opening 109 in the front-to-rear direction.

As shown in FIG. 22 and FIG. 24, the grid-side return contact part 119 is formed on the outer wall surface of the upper inner wall 88 at the rear edge of the grid-side opening 118. The grid-side return contact part 119 protrudes slightly outward in the width direction from the outer wall surface of the upper inner wall 88. Seen in a bottom view, the grid-side return contact part 119 is substantially L-shaped with the rear side protruding farthest outward in the width direction.

As shown in FIG. 12, the grid-side projection contact part 120 is the portion on the inner wall surface of the upper inner wall 88 constituting the peripheral edge of the outer grid fitting part 113. The grid-side projection contact part 120 is therefore a planar surface forming three sides of a rectangle in a side view.

As shown in FIG. 4 and FIG. 12, the beam injection unit 97 includes a beam injection opening 121 formed in front of the charger support unit 96 and having a substantially elongated rectangular shape in a plan view extending in the width direction; and a front injection plate 141 and a rear injection plate 142 opposing each other in the front-to-rear direction with the beam injection opening 121 formed therebetween.

The front injection plate 141 is disposed on the front side of the beam injection opening 121 and extends in the width direction of the top wall 91. The front injection plate 141 protrudes at a slant downward and to the rear from the inner wall surface of the top wall 91. The rear injection plate 142 is disposed on the rear side of the beam injection opening 121 and extends in the width direction of the top wall 91. The rear injection plate 142 protrudes downward from the inner wall surface of the top wall 91.

In a side view, the beam injection unit 97 is substantially triangular-shaped, growing narrower in the downward direction. While the scanning unit 19 emits a laser beam, the laser beam enters the beam injection opening 121, passing between the front injection plate 141 and rear injection plate 142, and is scanned in a high speed over the surface of the photosensitive drum 28.

(iv) Cleaning Member

As shown in FIG. 4 and FIG. 15, the cleaning member 32 includes the cleaning brush 65 and support plate 66 as described above.

The support plate 66 is configured of an electrically conductive metal plate formed in an elongated rectangular shape that extends along the width of the drum casing 76. The cross section of the support plate 66 is substantially shaped like three sides of a rectangle. Engaging through-holes 68 are formed in vertically opposing portions of the support plate 66 at both longitudinal ends thereof for engaging with the front pawl 102 and rear pawl 103 of the engaging parts 98.

The cleaning brush 65 is configured of a nonwoven cloth fixed across the surface of the support plate 66 between the engaging through-holes 68 at the longitudinal ends of the support plate 66 by a double-sided tape. The nonwoven cloth includes a plurality of electrically conductive brush bristles implanted therein, forming a shape that is substantially rectangular in a side view and the extends along the longitudinal direction of the cleaning brush 65.

(v) Cleaning Terminal

As shown in FIG. 13 and FIG. 14, the cleaning terminal 67 is configured of a leaf spring that is formed separately from the cleaning member 32. The cleaning terminal 67 is integrally configured of an inside part 122 that engages with the right-side engaging part 98*b*, and an outside part 123 disposed farther outside than the inside part 122 in the width direction that engages with the cleaning-member-side opening 105.

The inside part 122 is a flat plate having an elongated rectangular shape. The inner portion of the inside part 122 in the width direction functions as an elastic contact part 124 formed in an arc shape that protrudes forward (toward the support plate 66).

The outside part 123 is a flat plate having an elongated rectangular shape.

As shown in FIG. 13, an edge of the cleaning terminal 67 with respect to a direction (a widthwise direction of the cleaning terminal 67) orthogonal to the width direction (longitudinal direction of the cleaning terminal 67) on the widthwise outer portion of the inside part 122 joins with another edge of the cleaning terminal 67 with respect to a direction orthogonal to the width direction at the widthwise inner portion of the outside part 123 to form the obtuse angle. Thus, the widthwise outer portion of the inside part 122 and the widthwise inner portion of the outside part 123 are connected so that the cross section of the inside part 122 and outside part 123 taken orthogonal to the width direction forms a V-shape at a prescribed obtuse angle.

The widthwise outer portion of the outside part 123 has a hook shape when viewed from the bottom (folded back in a U-shape in a bottom view). The free end of this hook shape is a return-restricting part 125 that restricts the outside part 123 of the cleaning terminal 67 from returning into the upper casing 78. A midway portion of the U-shaped folded part functions as a contact part 127. The contact part 127 contacts a cleaning-member-side fixed contact point 126 provided on the main casing 2.

Hence, as shown in FIG. 14, the outside part 123 includes a portion 123*a* on the return-restricting part 125 side of the contact part 127 and a portion 123*b* on the opposite side of the contact part 127 from the return-restricting part 125 (a projection-restricting part 128 side described later). The distance between these two portions 123*a* and 123*b* of the outside part 123 is slightly greater than the front-to-rear width of the cleaning-member-side opening 105 when the outside part 123 is not inserted through the cleaning-member-side opening 103.

The outer edge of the inside part 122 on the widthwise outer portion forms the projection-restricting part 128 for restricting the cleaning terminal 67 from projecting out of the upper casing 78. Further, a side edge of the inside part 122 abutting the adjoined region between the inside part 122 and outside part 123 and an inside edge of the outside part 123 adjacent to the side edge of the inside part 122 form the terminal-engaging part 129 for engaging with the cutout part 104 of the base part 101.

In the cleaning terminal 67 having this construction, the inside part 122 and outside part 123 are formed continuously. Further, the return-restricting part 125 disposed on the free end of the outside part 123, the projection-restricting part 128 that is provided opposite to the return-restricting part 125, in other words, that is provided on the outer edge of the inside part 122, and the contact part 127 disposed between the return-restricting part 125 and projection-restricting part 128 on the portion of the outside part 123 that protrudes farthest outward in the width direction are all formed integrally and continuously.

(vi) Mounting the Cleaning Member and Cleaning Terminal on the Upper Casing

In order to mount the cleaning terminal 67 in the upper casing 78, first the outside part 123 of the cleaning terminal 67 is inserted through the cleaning-member-side opening 105 between the guide plate 106 and cleaning-member-side return contact part 107 of the lower outer wall 89 from inside the upper casing 78. The outside part 123 is inserted through the cleaning-member-side opening 105 until the contact part 127 is exposed outside the upper casing 78 through the cleaning-member-side opening 105. Next, the outside part 123 is retracted in the cleaning-member-side opening 105 until the return-restricting part 125 contacts the return-restricting pawl 110 of the cleaning-member-side return contact part 107. Further, the terminal-engaging part 129 is placed in contact with the cutout part 104 so that the inside part 122 of the cleaning terminal 67 is engaged in the cutout part 104.

At this time, the return-restricting part 125 contacts the return-restricting pawl 110 from the widthwise outer side thereof, while the projection-restricting part 128 confronts and is capable of contacting the cleaning-member-side projection contact part 108 from the widthwise inner side thereof. Thus, the cleaning terminal 67 is slidably mounted in the upper casing 78, and is detachable from the upper casing 78. Further, the contact part 127 is positioned on the widthwise outer side of the lower outer wall 89 and is covered from above and below by the cleaning covers 109.

With this construction, the return-restricting part 125 and projection-restricting part 128 are disposed so as to contact the return-restricting pawl 160 and the cleaning-member-side projection contact part 108, respectively, in opposite directions. Further, the portion 123*b* of the outside part 123 on the projection-restricting part 128 side of the contact part 127 and the portion 123*a* of the outside part 123 on the return-restricting part 125 side of the contact part 127 elastically contact the guide plate 106 and cleaning-member-side return contact part 107 at the peripheral edges of the cleaning-member-side opening 105 in a direction in which the portions 123*a* and 123*b* move away from each other to expand the distance therebetween. This construction therefore fixes the position of the cleaning terminal 67.

(vii) Mounting the Cleaning Member

After the cleaning terminal 67 is mounted as described above, the cleaning member 32 is mounted on the upper casing 78. As shown in FIG. 15 and FIG. 16, the cleaning member 32 is mounted on the upper casing 78 by first positioning the support plate 66 opposite the front side of the cleaning support unit 95 and engaging the engaging through-holes 68 over the front pawl 102 and rear pawl 103 of the base part 101. At this time, the support plate 66 is resting on the support pieces 99 and the base parts 101, and the cleaning member 32 is supported on the upper casing 78.

By mounting the cleaning member 32 in this way, the elastic contact part 124 of the cleaning terminal 67 elastically contacts the support plate 66 from the side of the support plate 66 opposite the photosensitive drum 28.

(viii) Grid

As shown in FIG. 17, the grid 72 includes a grid support member 74, and a grid electrode 75 supported on the grid support member 74.

The grid support member 74 is formed of a metal plate extending in the width direction and having a cross section shaped like three sides of a rectangle. The grid support member 74 is integrally provided with a flat plate part 130 for supporting the grid electrode 75, and side plate parts 131 (front-side plate part 131*f* and rear-side plate part 131*r*) extending upward from both front-to-rear edges of the flat plate part 130 and extending parallel to each other.

An electrode opening 139 for accommodating the grid electrode 75 is formed in the flat plate part 130 across the width direction thereof in a substantially elongated rectangular shape.

The grooves 132 are formed in both widthwise ends of each side plate part 131. The grooves 132 are cut out from the upper edges of the side plate parts 131 in substantially L shapes.

The grid electrode 75 is formed of a plurality of electrode lines 133 arranged parallel to one another and spaced at intervals in the front-to-rear direction. The electrode lines 133 are fixed in the electrode opening 139 at both widthwise ends of the flat plate part 130.

(ix) Grid Terminal

As shown in FIG. 17 and FIG. 22, the grid terminal 73 is configured of a leaf spring integrally provided with the grid support member 74 on one widthwise and (right-side end) thereof. The grid terminal 73 includes a projection-restricting part 134 configured of the widthwise edge (right-side edge) of the grid support member 74 for restricting the grid terminal 73 from projecting out of the upper casing 78, and a protruding part 135 protruding outward in the width direction from the widthwise edge (right-side edge) of the grid support member 74.

The projection-restricting part 134 is configured as the outer edge of the grid support member 74 and is formed in the shape of three side of a rectangle.

The protruding part 135 is substantially hook-shaped from a bottom view. That is, the protruding part 135 protrudes outward in the width direction from the widthwise edge (right-side edge) of the rear-side plate part 131*r*, and is folded back in a U-shape. The free end of the protruding part 135 serves as a return-restricting part 136 for preventing the grid 72 from returning inward into the upper casing 78. A midway portion of the U-shaped folded part constitutes a contact part 138. The contact part 138 contacts a grid-side fixed contact point 137 provided on the main casing 2.

The protruding part 135 is configured of a portion 135*a* on the return-restricting part 136 side of the contact part 138 and a portion 135*b* on the opposite side of the contact part 138 from the return-restricting part 136 (the projection-restricting part 134 side) that oppose each other. The portion 135*b* extends outward in the width direction from the widthwise edge (right-side edge) of the rear-side plate part 131*r*, and is flush with the rear-side plate part 131*r*. The distance between these opposing parts 135*a* and 135*b* is formed slightly wider than the front-to-rear width of the grid-side opening 118 when the protruding part 135 is not inserted through the grid-side opening 118.

In the grid terminal 73 having this construction, the protruding part 135 and projection-restricting part 134 are formed continuously. Further, the return-restricting part 136 provided on the free end of the protruding part 135, the projection-restricting part 134 that is provided opposite the return-restricting part 136, in other words, that is provided on the outer edge of the grid support member 74, and the contact part 138 disposed between the return-restricting part 136 and projection-restricting part 134 on the portion of the protruding part 135 protruding farthest outward in the width direction are all formed integrally and continuously.

(x) Mounting the Grid and Grid Terminal on the Upper Casing

In order to mount the grid 72 and grid terminal 73 on the upper casing 78, first the grid 72 is positioned opposite the charger support unit 96, as shown in FIG. 17. Next, the grid support member 74 is fitted between the front holding plate 111 and rear holding plate 112 so that the grooves 132 receive the protrusions 117, as shown in FIG. 18, FIG. 19, and FIG. 20.

Next, as illustrated in FIG. 26, the grid support member 74 is slid rightwardly in the width direction between the front holding plate 111 and rear holding plate 112 so that the protruding part 135 of the grid terminal 73 is inserted through the grid-side opening 118 from the inside of the upper casing 78. At this time, the protruding part 135 protrudes through the grid-side opening 116 so that the contact part 138 is exposed outside the upper casing 78 through the grid-side opening 118. Finally, as illustrated in FIG. 21, FIG. 22, FIG. 23, the projection-restricting part 134 contacts the grid-side projection contact part 120. At the same time, the return-restricting part 136 contacts the grid-side return contact part 119 as shown in FIG. 22 and FIG. 24.

By thus sliding the grid support member 74 rightwardly along the width direction between the front holding plate 111 and rear holding plate 112, the widthwise end of the grid support member 74 is fitted over the outer grid fitting part 113. Additionally, the protrusions 117 are inserted into the deepest portion of the L-shaped grooves 132 and are engaged therewith as shown in FIG. 23.

Through this assembly process, the return-restricting part 136 contacts the grid-side return contact part 119 from the widthwise outer side thereof, while the projection-restricting part 134 confronts and is capable of contacting the grid-side projection contact part 120 from the widthwise inner side thereof. Additionally, the contact part 138 is disposed on the widthwise outer side of the upper inner wall 88.

The return-restricting part 136 and projection-restricting part 134 are disposed so as to contact the grid-side return contact part 119 and grid-side projection contact part 120, respectively, in opposite directions. Further, the portion 135*b* of the protruding part 135 on the projection-restricting part 134 side of the contact part 138 and the portion 135*a* of the protruding part 135 on the return-restricting part 136 side of the contact part 138 elastically contact peripheral edges of the grid-side opening 118 in a direction in which the portions 135*b* and 135*a* move away from each other to expand the distance therebetween. This construction therefore fixes the position of the grid terminal 73.

By fitting the grooves 132 of the grid support member 74 over the respective protrusions 117, the grid 72 is fixed between the front holding plate 111 and rear holding plate 112 in the charger support unit 96.

Next, a grid terminal cover 144 is mounted on the upper inner wall 88, as shown in FIG. 25. The grid terminal cover 144 functions to cover the protruding part 135 exposed on the outside of the upper casing 78 via the grid-side opening 118. The grid terminal cover 144 is mounted on the upper inner wall 88 by placing front and lower edge portions of the grid terminal cover 144 in contact with the step wall. 90, and inserting a hook part 147 disposed on a rear edge of the grid terminal cover 144 into an engaging through-hole 148 formed in the upper inner wall 88 rearward of the grid-side opening 118. When the grid terminal cover 144 is mounted on the upper inner wall 88, the grid terminal cover 144 is flush with the lower outer wall 89 in the width direction.

A cover-side opening 145 is formed in the grid terminal cover 144 for exposing the contact part 138 of the grid terminal 73. The cover-side opening 145 has an elongated rectangular shape extending vertically and is disposed in a position opposite the grid-side opening 118 in the width direction.

Grid covers 146 are provided on an outer wall surface of the grid terminal cover 144 at the upper and lower edges of the cover-side opening 145 for covering the grid terminal 73 from above and below.

As described above, when mounting the grid terminal 73 on the upper casing 78, as described above with reference to FIG. 19 and FIG. 26, the grid support member 74 is slid rightwardly in the width direction between the front holding plate 111 and rear holding plate 112 so that the protruding part 135 of the grid terminal 73 is inserted through the grid-side opening 118 from the inside of the upper casing 78. Thus, the grid 72 and the grid terminal 73 are slidably mounted on the upper casing 78, and are detachable from the upper casing 78.

It is desirable that the opening width W1 of the grid-side opening 118, shown in FIG. 26, has a value slightly smaller than the distance between opposing portions 135*a* and 135*b* of the protruding part 135 when the protruding part 135 is not inserted in the grid-side opening 118. In this case, the protruding part 135 can fit in the grid-side opening 118 in a proper degree of tightness.

If the opening width W1 of the grid-side opening 118 were too narrow with respect to the distance between opposing portions 135*a* and 135*b* of the protruding part 135, however, the protruding part 135 may fit too tightly in the grid-side opening 118, increasing the difficulty of the assembly process.

While it is possible to reduce the thickness of the protruding part 135, for example, to ensure smooth insertion into the grid-side opening 118 in such a case, it is difficult to reduce only the thickness of the protruding part 135 since the protruding part 135 is formed integrally and continuously with the grid support member 74.

Figure 27:
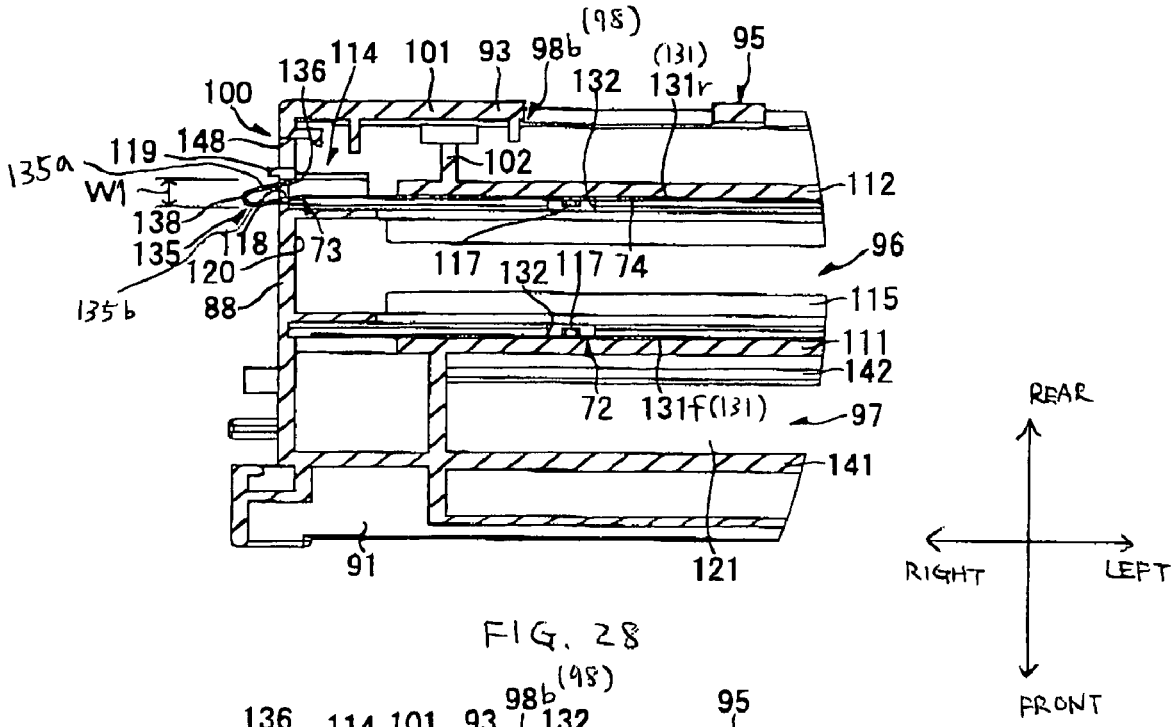
FIG. 27 is a horizontal cross-sectional view of the upper casing that corresponds to FIG. 26 and therefore that shows the state where the grid is being mounted and that illustrates a problem that will possibly occur while the grid is being mounted if an opening width of a grid-side opening has a relatively large value.

Hence, it is conceivable to change the opening width W1 of the grid-side opening 118 to a sufficiently large value as shown in FIG. 27. In this case, the protruding part 135 can be smoothly inserted into the grid-side opening 118.

Figure 28:
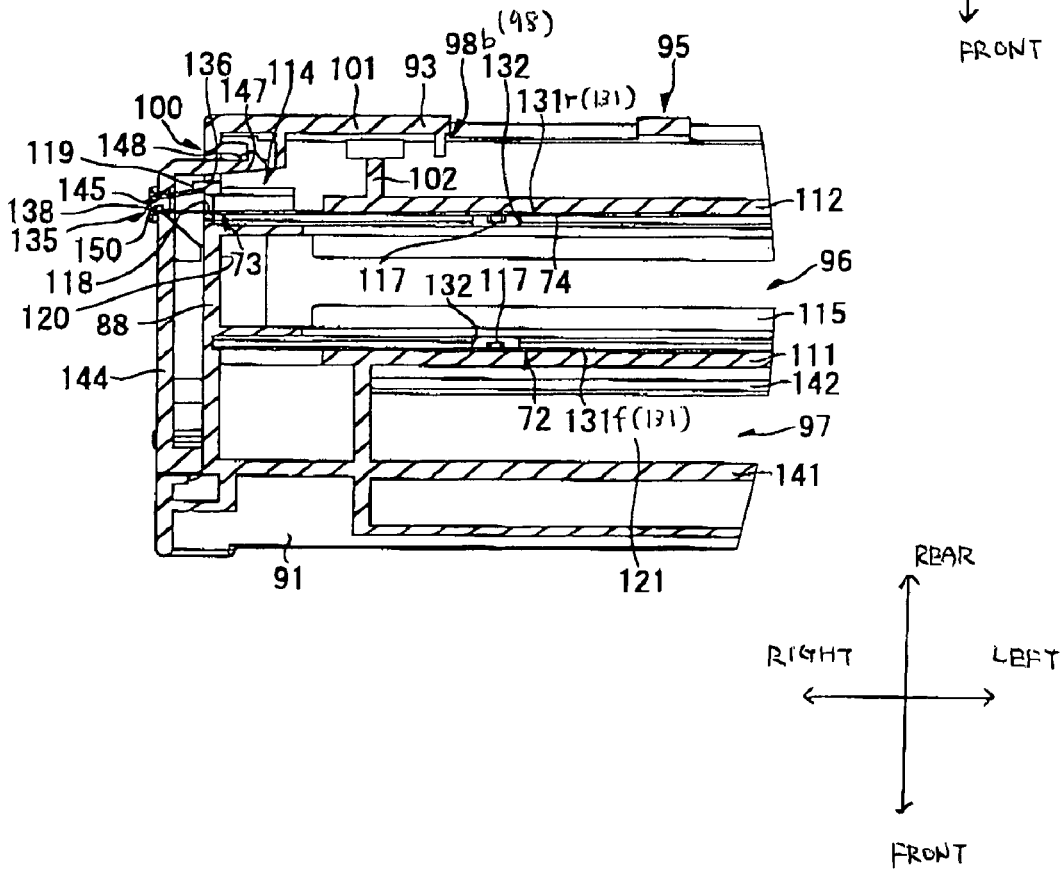
FIG. 28 is a horizontal cross-sectional view of the upper casing in FIG. 27 after the grid is completely mounted illustrating how the problem is overcome by mounting the grid terminal cover.

When the protruding part 135 is inserted through the grid-side opening 118, however, if the portion 135*a* of the protruding part 135 on the return-restricting part 116 side of the contact part 138 contacts the grid-side opening 118, the portion 135*b* of the protruding part 135 on the projection-restricting part 134 side of the contact part 138 will possibly bend forward from the grid-side opening 118. This forward lean of the protruding part 135 can be corrected by mounting the grid terminal cover 144 on the upper inner wall 88 so that the contact part 138 is inserted through the cover-side opening 145 formed in the grid terminal cover 144, as shown in FIG. 25 and FIG. 28, thereby enabling accurate positioning of the contact part 138. In other words, the forward bending in the protruding part 135 can be corrected by a front wall portion 150 forming a front edge of the cover-side opening 145 that receives the portion 135*b* of the protruding part 135 on the projection-restricting part 134 side of the contact part 138.

(xi) Mounting the Upper Casing on the Lower Casing

As described above, after the transfer roller 31 and electrode member 215 are mounted in the lower casing 77 and the cleaning member 32, cleaning terminal 67, grid 72, grid terminal 73, and other members are assembled on the upper casing 78, the main drum body 33 is positioned on the drum support unit 80 of the lower casing 77. Next, as shown in FIG. 6, the upper casing 78 is placed on top of the drum support unit 80 so that the through-holes 94 of the upper casing 78 are aligned in the width direction with insertion through-holes (not shown) formed in the lower casing 77. Subsequently, the drum shaft 34 is inserted through the through-holes 94 and the insertion through-holes in the lower casing 77 and through the main drum body 33 disposed therebetween. In this way, the upper casing 78 and lower casing 77 are attached to each other via the drum shaft 34.

When the upper casing 78 is attached to the lower casing 77, the drum shaft 34 of the photosensitive drum 28 is vertically aligned with the roller shaft 56 of the transfer roller 31, as shown in FIG. 10. Further, the transfer roller 31 is positioned below the photosensitive drum 28 and is configured such that the roller 37 of the transfer roller 31 can freely contact or separate from the main drum body 33 of the photosensitive drum 28.

More specifically, the transfer roller 31 is loosely fitted in the lower casing 77 so as to be capable of moving vertically with some play. However, with the photosensitive drum 28 is disposed above the transfer roller 31, upward movement of the transfer roller 31 is restricted by contact between the roller 57 of the transfer roller 31 and the main drum body 33 of the photosensitive drum 28.

However, when the drum cartridge 27 is removed from the main casing 2, the transfer roller 31 separates from the photosensitive drum 28. That is, when the drum cartridge 27 is removed from the main casing 2, the transfer roller 31 is disposed such that the ends of the roller shaft 56 are received in the bearing plates 204 and the collars 213 are received in the collar-receiving plates 236.

(xii) Mounting the Drum Cartridge in the Main Casing

As shown in FIG. 7 and FIG. 8, the power-feeding member 230 provided in the main casing 2 contacts the base end 216 of the electrode member 215 when the drum cartridge 27 is mounted in the main casing 2.

The power-feeding member 230 is configured of a leaf spring that has a substantially elongated rectangular shape. The power-feeding member 230 is fixed on the inside surface of the main casing 2 and elastically protrudes inward in the width direction. The power-feeding member 230 is fixed at a position capable of contacting the base end 216 of the electrode member 215 on the outer widthwise side when the drum cartridge 27 is mounted in the main casing 2. The power-feeding member 230 is connected to the power supply 300 for transmitting a transfer bias therefrom.

As shown in FIG. 10, roller-urging parts 231 are provided in the main casing 2 for urging the roller shaft 56 of the transfer roller 31 upward. The roller-urging parts 231 are disposed at positions vertically opposing the openings 232 formed in the lower casing 77 when the drum cartridge 27 is mounted in the main casing 2. Each roller-urging part 231 includes a pivot arm 233, and a spring 234.

The pivot arm 233 is configured of a lever extending in the front-to-rear direction. The pivot arm 233 is rotatably supported on the main casing 2 via a pin 235 positioned at the front end of the pivot arm 233 so that the rear end of the pivot arm 233 pivots up and down.

The spring 234 is configured of a compressor spring arranged vertically below the rear end of the pivot arm 233. The bottom end of the spring 234 is fixed to the main casing 2, and the top end is coupled with the rear end of the pivot arm 233.

Since the spring 234 constantly urges the rear end of the pivot arm 233 upward, the rear end is always positioned slightly diagonally above the front end.

When the drum casing 76, and more specifically the drum cartridge 27, assembled as described above is mounted in the main casing 2, the collars 213 provided at both ends of the roller shaft 56 contact the rear ends of the pivot arms 233 in the roller-urging parts 231 via the openings 232, as shown in FIG. 10. At this time, the collars 213 apply a downward pressure on the rear ends of the pivot arms 233, causing the pivot arms 233 to oppose the urging force of the springs 234 until the rear ends and front ends of the pivot arms 233 are positioned at substantially equal heights vertically. At the same time, the pivot arms 233 are urged upward by the springs 234 and apply a reaction force to the collars 213. As a result, the roller 56 of the transfer roller 31 contacts the main drum body 33 of the photosensitive drum 28 from the bottom with pressure.

Further, when the drum cartridge 27 is mounted in the main casing 2, as shown in FIG. 7 and FIG. 8, the power-feeding member 230 contacts the base end 216 of the electrode member 215 from the widthwise outer side thereof. Accordingly, the elastic force of the power-feeding member 230 urges the base end 216 inward in the width direction so that the contact surface 226 of the contact part 218 contacts the axial endface 227 of the roller shaft 56 at the axial center (rotational center) thereof.

With this construction, a transfer bias that the power supply 300 applies to the power-feeding member 230 is transmitted to the roller shaft 56 of the transfer roller 31 via the electrode member 215.

Further, the transfer roller 31 slides inward in the width direction when the drum cartridge 27 is mounted in the main casing 2 since the contact surface 226 of the contact part 218 is pressed against the axial endface 227 of the roller shaft 56 in the width direction when the electrode member 215 is urged inward by the power-feeding member 230. Hence, as shown in FIG. 8, the axial endface 229 at the other end (left-side end) of the roller shaft 56 contacts the inner side of the shaft contact part 203 in the width direction via the transfer roller gear 214, thereby positioning the transfer roller 31 in the width direction (axial direction).

As shown in FIG. 14, when the drum cartridge 27 is mounted in the main casing 2, the contact part 127 of the cleaning terminal 67 contacts the cleaning-member-side fixed contact point 126 provided in the main casing 2. The cleaning-member-side fixed contact point 126 is connected to the power supply 300 (FIG. 14) that is provided in the main casing 2 also for applying a cleaning bias. Since the contact part 127 of the cleaning terminal 67 contacts the cleaning-member-side fixed contact point 126 and the elastic contact part 124 contacts the support plate 66, a cleaning bias applied via the cleaning-member-side fixed contact point 126 is transmitted to the cleaning member 32 via the cleaning terminal 67.

As shown in FIG. 22, when the drum cartridge 27 is mounted in the main casing 2, the contact part 138 of the grid terminal 73 contacts the grid-side fixed contact point 137 provided in the main casing 2. The grid-side fixed contact point 137 is connected to the power supply 300 (FIG. 22) that is provided in the main casing 2 also for applying a grid bias. Since the contact part 188 of the grid terminal 73 contacts the grid-side fixed contact point 137 and since the grid terminal 73 is integrally formed with the grid 72, the grid bias applied from the grid-side fixed contact point 137 is transferred to the grid 72 via the grid terminal 73.

When the drum cartridge 27 is mounted in the main casing 2, a rear endface on the top wall 91 constituting the drum cartridge 27 contacts the sponge member 216 provided on the front side on the lower end of the duct 242, as shown in FIG. 3. Additionally, the protruding part 244 protruding from the top end of the upper rear wall 93 is wedged into the sponge member 246 from the bottom thereof, forming a tight seal between the duct 242 and upper casing 78.

With this construction, an airflow F can be reliably formed by air flowing into the charger support unit 96 of the upper casing 78 through the charger slot 245 and being drawn to the duct 242 through the openings 243. As a result, it is possible to reliably ventilate ozone produced by the charger 29.

(2) Operations and Effects of the Drum Casing and the Transfer Roller

As described above, when mounting the electrode member 215 on the lower rear right-side wall 86*b* in the drum cartridge 27, the engaging parts 217 and contact part 218 of the electrode member 215 are fitted from outside the lower rear right-side wall 86*b* into the lower rear right-side wall 86*b* in the width direction via the insertion opening part 208 to mount the electrode member 215 on the lower rear right-side wall 86*b* in one operation. Therefore, this construction can improve the assembly efficiency of the electrode member 215 and can therefore improve productivity and simplify replacement operations.

More specifically, by inserting the engaging parts 217 and contact part 218 of the electrode member 215 into the right-side wall 86 through the insertion opening part 208 from a position outside the right-side wall 36 with respect to the width direction, it is possible to place the power-feeding member 230 in contact with the base end 216 while the engaging parts 217 are engaged with the lower rear right-side wall 86*b* and the contact surface 226 of the contact part 218 is in contact with the axial endface 227 of the roller shaft 56. Therefore, it is possible to provide a simple construction that enables the electrode member 215 to be reliably engaged with the lower rear right-side wall 86*b* and in contact with the axial endface 227 of the roller shaft 56 in a single operation. As a result, the electrode member 215 can be mounted in one step and can reliably apply a transfer bias.

Further, the contact surface 226 of the contact part 218 contacts the axial endface 227 of the roller shaft 56 at the axial center (rotational center) thereof; the contact part 218 is interposed between the engaging parts 217; and the engaging surfaces 224 engage with the inner surface 225 of the lower rear right-side wall 86*b* on the front and rear edges of the insertion opening parts 208. Accordingly, it is possible to prevent movement of the roller shaft 56 in the axial direction and to reduce friction between the contact surface 226 and the axial endface 227 of the roller shaft 56, while reliably engaging the electrode member 215 with the lower rear right-side wall 86*b* and placing the electrode member 215 in contact with the axial endface 227 of the roller shaft 56 through a simple construction.

In the above description, the electrode member 215 is mounted after mounting the transfer roller 31 and prior to mounting the photosensitive drum 28 (mounting the upper casing 78 on the lower casing 71). However, the electrode member 215 may be mounted after mounting the photosensitive drum 28 or before mounting the transfer roller 31, for example, and is not restricted to the order described above.

The side restricting part 207 is positioned between the base end 216 and the axial endface 227 of the roller shaft 56 with respect to the width direction. After the electrode member 215 is mounted on the drum cartridge 27 and before the drum cartridge 27 is mounted on the main casing 2, even if the transfer roller 31 loosely fitted in the lower casing 77 moves rightwardly in the width direction, the axial endface 227 will contact the restricting surface 228 of the side restricting part 207, whereby the side restricting part 207 will restrict further movement of the roller shaft 56 in the width direction, preventing the roller shaft 56 from contacting the base end 216. Accordingly, it is possible to prevent damage to the electrode member 215 due to contact from the axial endface 227 of the roller shaft 56 and to prevent the electrode member 215 from falling out the lower rear right-side wall 86*b*.

When the drum cartridge 27 is mounted in the main casing 2 so that the position of the transfer roller 31 in the width direction (axial direction) is fixed, the electrode member 215 is positioned such that a distance X1 in the width direction between the engaging surfaces 224 of the pawls 223 and the inner surface 225 of the lower rear right-side wall 86*b* on the peripheral edge of the insertion opening part 208 is greater than the distance X2 between the restricting surface 228 of the side restricting part 207 and the axial endface 277 of the roller shaft 56. Hence, even if the transfer roller 31 that is loosely fitted in the lower casing 77 moves in the width direction prior to mounting the drum cartridge 27 in the main casing 2, the axial endface 227 of the roller shaft 56 contacts the restricting surface 228 of the side restricting part 207 prior to the engaging surfaces 224 of the pawls 223 contacting the inner surface 225 of the lower rear right-side wall 86*b* at the peripheral edge of the insertion opening part 208. Accordingly, it is possible to provide a simple construction capable of reliably preventing damage to the electrode member 215 due to contact by the axial endface 227 of the roller shaft 56 and of reliably preventing the electrode member 215 from falling out the lower rear right-side wall 86*b*.

When the drum cartridge 27 is mounted in the main casing 2, the transfer roller 31 is pressed inward in the width direction as the electrode member 215 contacts the power-feeding member 230, thereby positioning the transfer roller 31 in the width direction (axial direction). Accordingly, the transfer roller 31 can be reliably positioned in the width direction through a simple construction.

Further, the transfer roller 31 is supported in the lower casing 77 in a loose state so that the transfer roller 31 contacts the photosensitive drum 28 when the drum cartridge 27 is mounted in the main casing 2 and separates from the photosensitive drum 28 when the drum cartridge 27 is removed from the main casing 2. Through a simple construction in which the contact surface 226 of the contact part 218 contacts the axial endface 227 of the roller shaft 56 from the outer side in the width direction, the electrode member 215 can be reliably made to contact the axial endface 227 of the roller shaft 56 that is mounted in the loose state in the lower casing 77. Further, by placing the contact surface 226 of the contact part 218 in contact with the axial endface 227 of the roller shaft 56 in the axial direction, it is possible to reduce the load on the transfer roller 31 when the transfer roller 31 rotates.

By providing the laser printer 1 with the drum cartridge 27 having improved productivity and simplified replacement operations, as described above, it is possible to reduce the manufacturing costs and running costs of the laser printer 1.

(3) Operations and Effects of the Cleaning Terminal and Grid Terminal

In the drum cartridge 27 having the structure described above, the cleaning terminal 67 is mounted on the upper casing 78 by sliding the outside part 123 of the cleaning terminal 67 through the cleaning-member-side opening 105 so that the contact part 127 is inserted through the cleaning-member-side opening 105 and protrudes outside the upper casing 78 via the cleaning-member-side opening 105. At this time, the return-restricting part 126 restricts the outside part 123 from returning into the upper casing 78, while the projection-restricting part 128 restricts the outside part 123 from protruding farther out of the upper casing 78. Accordingly, the contact part 127 protruding out of the upper casing 78 can be accurately positioned and reliably fixed in the width direction of the upper casing 78 through a simple construction.

More specifically, the cleaning terminal 67 is mounted on the upper casing 78 by first inserting the outside part 123 of the cleaning terminal 67 through the opening 105 formed in the upper casing 78 from the inside thereof. Next, by sliding the outside part 123 of the cleaning terminal 67 through the opening 105, the return-restricting pawl 110 from a widthwise outer side thereof, while the projection-restricting part 128 is disposed so as to be capable of contacting the projection contact part 108 from a widthwise inner side thereof.

Further, the cleaning terminal 67 is configured of a leaf spring, and the return-restricting part 125, projection-restricting part 128, and contact part 127 are formed integrally and continuously. Therefore, it is possible to reduce the number of parts required to accurately position the contact part 127 without providing special positioning members.

Further, the cleaning terminal 67 simply provides the return-restricting part 125 and projection-restricting part 128 in contact with or capable of contracting the return-restricting pawl 110 and cleaning-member-side projection contact part 108 from opposite directions along the width direction. Therefore, the cleaning terminal 67 can be easily assembled on the upper casing 78, while accurately positioning the contact part 127 provided between the return-restricting part 125 and projection-restricting part 128 with respect to the width direction of the upper casing 78.

Further, by forming the cleaning terminal 67 of a leaf spring, it is possible to reduce the number of parts and the manufacturing costs, while accurately positioning the contact part 127 in the width direction of the upper casing 78.

Further, the outside part 123 of the cleaning terminal 67 includes the portion 123*b* on the projection-restricting part 128 side of the contact part 127 and the opposing portion 123*a* on the return-restricting part 125 side of the contact part 127 that expand away from each other to elastically contact the guide plate 106 and cleaning-member-side return contact part 107 at the peripheral edges of the cleaning-member-side opening 105. Hence, the cleaning terminal 67 can be simply and reliably mounted in the upper casing 78, while accurately positioning the contact part 127 in the width direction of the upper casing 78.

Further, since the cleaning terminal 67 is formed separately from the cleaning member 32, the cleaning terminal 67 can be accurately positioned independent from the assembly of the cleaning member 32.

Further, since the elastic contact part 124 of the cleaning terminal 67 elastically contacts the support plate 66 from the side opposite the photosensitive drum 28, a reliable connection can be formed between the cleaning terminal 67 and cleaning member 32.

With the cleaning terminal 67 and cleaning member 32 mounted as described above, the cleaning-member-side fixed contact point 126 provided in the main casing 2 and connected to the power supply 300 can reliably apply a cleaning bias to the cleaning member 32 via the cleaning terminal 67, thereby achieving reliable image formation.

When mounting the grid 72 and grid terminal 73 on the upper casing 78 in the drum cartridge 27 described above, the protruding part 135 of the grid terminal 73 is slid toward the grid-side opening 118 so that the contact part 138 is exposed outside the upper casing 78 via the grid-side opening 118. At this time, the return-restricting part 136 restricts the protruding part 135 from returning into the upper casing 78, while the projection-restricting part 134 restricts the protruding part 135 from protruding farther out of the upper casing 78. Accordingly, the contact part 138 can be accurately positioned outside the upper casing 78 with respect to the width direction of the upper casing 78 and can be reliably fixed through a simple construction.

Further, the grid terminal 73 is configured of a leaf spring, and the return-restricting part 136, projection-restricting part 134, and contact part 138 are formed integrally and continuously. Therefore, it is possible to reduce the number of parts required to position the contact part 138 accurately without requiring special positioning members.

Further, the grid terminal 73 having the construction described above simply provides the return-restricting part 136 and projection-restricting part 134 in contact with or capable of contacting the grid-side return contact part 119 and grid-side projection contact part 120 from opposite directions along the width direction. Therefore, the grid terminal 73 can be easily mounted on the upper casing 78, while accurately positioning the contact part 138 disposed between the return-restricting part 136 and projection-restricting part 134 in the width direction of the upper casing 78.

Further, by forming the grid terminal 73 of a leaf spring, it is possible to reduce the number of required parts and the manufacturing costs, while accurately positioning the contact part 138 in the width direction of the upper casing 78.

Further, the protruding part 135 of the grid terminal 73 includes the portion 135*b* on the projection-restricting part 134 side of the contact part 138 and the opposing portion 135*a* on the return-restricting part 136 side of the contact part 138 that expand away from each other to elastically contact the peripheral edges of the grid-side opening 118. Hence, the grid terminal 73 can be easily and reliably mounted on the upper casing 78 while accurately positioning the contact part 138 in the width direction of the upper casing 78.

Further, since the grid terminal 73 is integrally formed with the grid 72, the number of required parts can be further reduced. Moreover, since the grid terminal 73 and grid 72 can be mounted together on the upper casing 78, this configuration can improve assembly efficiency.

Further, by sliding the grid support member 74 in the width direction when mounting the grid terminal 73 and grid 72 on the upper casing 78 until the protruding part 135 of the grid terminal 73 is exposed outside the upper casing 78 through the grid-side opening 118, the grooves 132 of the grid support member 74 are fitted over the protrusions 117 on the front holding plate 111 and rear holding plate 112, fixing the grid 72 to the upper casing 78. Accordingly, the grid terminal 73 and grid 72 can be easily and reliably mounted together through a process that further improves the assembly efficiency.

By mounting the grid terminal 73 and grid 72 on the upper casing 78, the grid-side fixed contact point 137 disposed in the main casing 2 and connected to the power supply 300 can reliably apply a grid bias to the grid 72 via the grid terminal 73, thereby achieving reliable image formation.

(4) Variation

Figure 29:
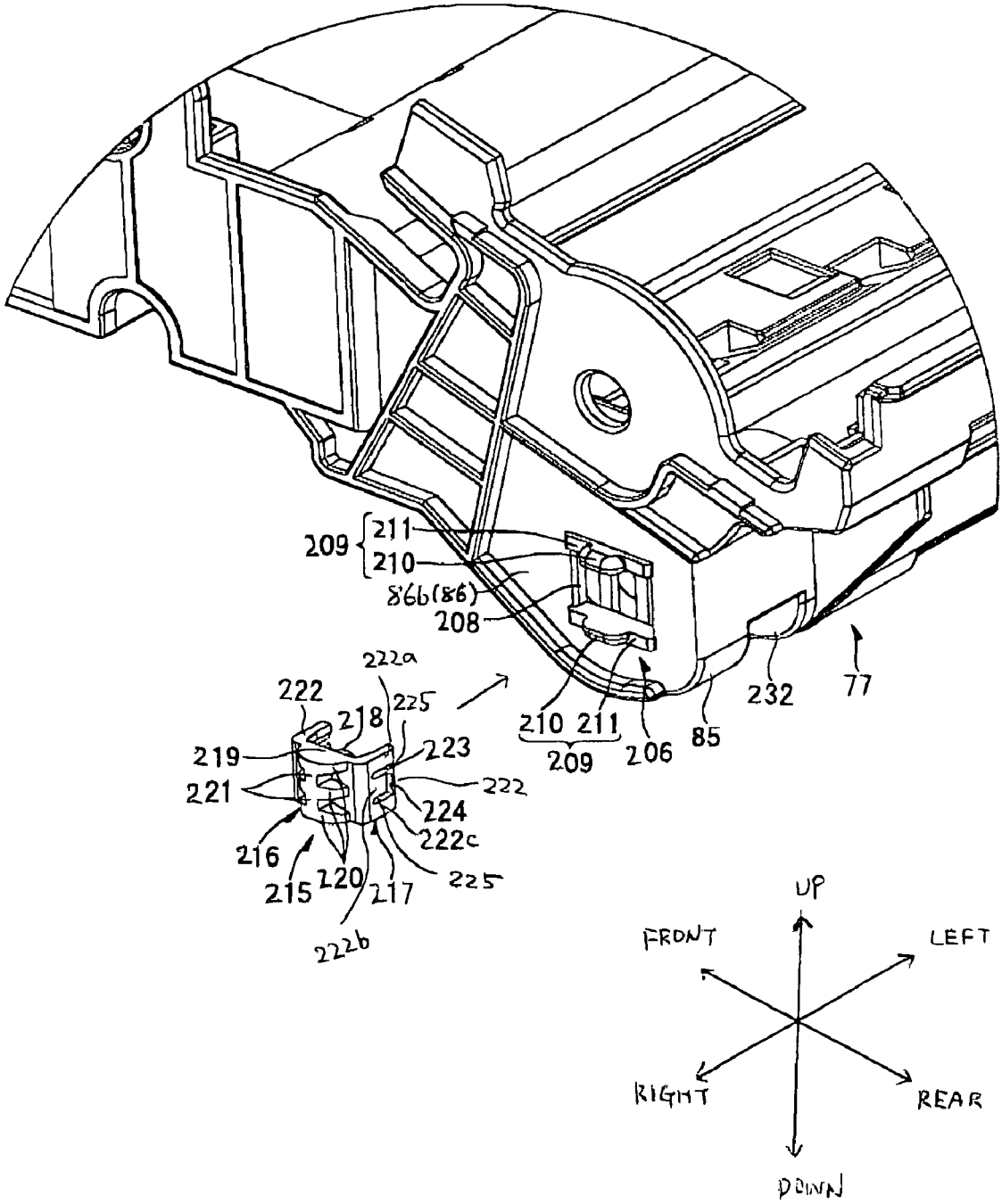
FIG. 29 is a perspective view illustrating a process for mounting an electrode member according to a variation.

FIG. 29 is a perspective view illustrating a method of mounting an electrode member according to a modification, wherein like parts and components are designated with the same reference numerals to avoid duplicating description.

In this variation, the base end 216 and contact part 218 are configured identical to those described above. Further, the engaging parts 217 are configured of the two side plates 222 extending inward in the width direction from front and rear sides of the base end 216 so as to oppose each other, and the pawls 223 disposed on the side plates 222, as described above. However, rather than forming the pawls 223 across the entire vertical inside edge of the side plates 222, as shown in FIG. 29, the pawls 223 in the variation are formed only in vertical center regions on the inside edges of the side plates 222.

Specifically, as shown in FIG. 29, each side plate 222 is divided into three sections 222*a*, 222*b*, and 222*c* that are juxtaposed vertically. The three sections 222*a*-222*c* are separated from one another with gaps 225 being formed therebetween, while being connected with one another at their outer widthwise edges. A pawl 223 is formed only on the section 222*b* of each side plate 222 that is located in the vertical center among the three sections 222*a*-222*c*. With this construction, less force is needed to bend the pawls 223 on the engaging parts 217 to bend the pawls 223 inward in the opposing direction of the side plates 222 when mounting the electrode member 215, thereby further improving the assembly efficiency.

While the invention has been described in detail with reference to the above aspects thereof, it would be apparent to those skilled in the art that various changes and modifications may be made therein without departing from the spirit of the invention.

Not only the transfer roller 31 but also other roller members, such as the developing roller 38, may have similar configurations to that of the transfer roller 31, provided that the roller members are mounted in the process cartridge 20 and receive a bias applied thereto. Electrode members, such as a developing roller terminal for applying a developing bias to the developing roller 38, may have similar configurations to that of the electrode member 215, and may be attached to the process cartridge 20 in contact with the roller members.

Similarly, terminal members for applying a bias to various bias-receiving members, such as the transfer roller 31 and the developing roller 38, in the process cartridge 20 may have the configurations similar to that of the cleaning terminal 67 or the grid terminal 73.

The developer cartridge 30 may be fixed to the drum cartridge 27 and therefore may not be removed from the drum cartridge 27.

In the above description, the electrode member 215 includes the two engaging parts 217 that are provided on both of the front and rear sides of the contact part 218. The two engaging parts 217 confront the contact part 218, with gaps being formed between the two engaging parts 217 and the contact part 218. However, the electrode member 215 may include only one engaging part 217 that is provided on one side of the contact part 218 and that confronts the contact part 218, with a gap being formed between the engaging part 217 and the contact part 218.

What is claimed is:

1. A cartridge that is detachably mountable in an image-forming device, the image-forming device having a power supply supplying an electrical bias, the cartridge comprising:

an image-forming component which receives the electrical bias;

a casing that is configured to accommodate the image-forming component, the casing having an opening formed therein; and a terminal member detachably mounted in the opening formed in the casing and exposed outside the casing via the opening to electrically connect the power supply to the image-forming component, the terminal member comprising:

a return-restricting part restricting the terminal member from returning into the casing;

a projection-restricting part that restricts the terminal member from further protruding out of the casing; and a contact part that is positioned outside the casing and that is electrically connected to the power supply, wherein the terminal member is hook-shape having a tip end and a base part;

the return-restricting part is disposed on the tip end of the terminal member, the projection-restricting part is disposed on the base part, and the contact part is disposed between the return-restricting part and the projection-restricting part; and the return-restricting part and the projection-restricting part are each capable of contacting the casing in opposing directions.

2. A cartridge according to claim 1, wherein the return-restricting part, projection-restricting part, and contact part of the terminal member are formed integrally.

3. A cartridge according to claim 2, wherein the terminal member is configured of a leaf spring.

4. A cartridge according to claim 3, wherein the terminal member elastically contacts a part of the casing next to the opening in a direction for expanding the distance between the return-restricting part and the projection-restricting part.

5. A cartridge according to claim 1, further comprising:

an image-carrying member that carries a developer image; and a charging unit having a discharge wire supplying an electrical charge to the image-carrying member, wherein the image-forming component is a grid that controls the amount of electrical charge that the discharge wire supplies to the image-carrying member.

6. A cartridge according to claim 5, wherein the grid and the terminal member are integrally formed.

7. A cartridge according to claim 6, wherein the grid comprises a fitting part that is fitted with the casing when the terminal member is exposed outside the casing through the opening formed therein.

8. A cartridge according to claim 1, further comprising an image-carrying member carrying a developer image, wherein the image-forming component is a cleaning member that removes matter deposited on the image-carrying member.

9. A cartridge according to claim 8, wherein the cleaning member and the terminal member are formed separately.

10. A cartridge according to claim 9, wherein the terminal member further comprises an elastic part elastically contacting the cleaning member from a side opposite the image-carrying member.

11. A cartridge according to claim 1, further comprising:

a roller member that receives another electrical bias supplied from the power supply provided in the image-forming device, the casing accommodating the roller member, the casing having another opening formed therein; and an electrode member inserted into the casing from the outer side thereof via the another opening formed in the casing and contacting an end of the roller member in its axial direction to electrically connect the power supply to the roller member.

12. A cartridge according to claim 11, wherein when the cartridge is mounted in the image-forming device, the electrode member contacts a power-feeding member, which is provided in the image-forming device and which is connected to the power supply, and is urged inward in the axial direction of the roller member; and the roller member becomes positioned in the axial direction through pressure from the urging electrode member.

13. A cartridge according to claim 11, wherein the electrode member comprises:

a base part that is urged by the power-feeding member;

an engaging part extending from the base part in a direction toward the roller member along the axial direction of the roller member to engage with the casing; and a contact part that extends from the base part in a direction toward the roller member in the axial direction of the roller member to contact an end surface of the roller member in the axial direction.

14. A cartridge according to claim 13, wherein the contact part comprises a contact surface that contacts the end surface of the roller member at its rotational center; and the engaging part is disposed confronting the contact part, with a gap being formed between the engaging part and the contact part, the engaging part comprising an engaging surface that engages with an inner surface of the casing at a peripheral edge of the another opening formed therein.

15. A cartridge according to claim 13, wherein the casing comprises a restricting member that is disposed between the base part of the electrode member and the roller member and that is capable of contacting the end surface of the roller member to restrict movement of the roller member toward the base part.

16. A cartridge according to claim 15, wherein the restricting member comprises a restricting surface opposing the end surface of the roller member, and wherein the electrode member is disposed so that the distance between the engaging surface of the engaging part and the inner surface of the casing in the axial direction of the roller member is greater than the distance between the end surface of the roller member and the restricting surface of the restricting member when the cartridge is mounted in the image-forming device.

17. A cartridge according to claim 11, further comprising a photosensitive member that carries an electrostatic latent image on the surface thereof and that receives a developer for developing the electrostatic latent image into a visible image, wherein the roller member is a transfer roller that transfers the visible image formed on the photosensitive member onto a recording medium, and the transfer roller is supported in the casing in a loosely fitted state so as to contact the photosensitive member when the cartridge is mounted in the image-forming device and to separate from the photosensitive member when the cartridge is removed from the image-forming device.

18. An image-forming device comprising:

a housing;

a power supply mounted in the housing and supplying an electrical bias;

a cartridge that is detachably mountable in the housing, the cartridge comprising:

an image-forming component which receives the electrical bias;

a casing that is configured to accommodate the image-forming component, the casing having an opening formed therein;

a terminal member detachably mounted in the opening formed in the casing and exposed outside the casing via the opening to electrically connect the power supply to the image-forming component, the terminal member comprising:

a return-restricting part restricting the terminal member from returning into the casing;

a projection-restricting part that restricts the terminal member from further protruding out of the casing; and a contact part that is positioned outside the casing and that is electrically connected to the power supply;

an image-carrying member that carries a developer image; and a charging unit having a discharge wire supplying an electrical charge to the image-carrying member, the image-forming component including a grid that controls the amount of electrical charge that the discharge wire supplies to the image-carrying member; and a fixing unit that is mounted in the housing and that fixes the developer image transferred onto a recording medium from the image-carrying member, wherein the terminal member is hook-shape having a tip end and a base part;

the return-restricting part is disposed on the tip end of the terminal member, the projection-restricting part is disposed on the base part, and the contact part is disposed between the return-restricting part and the projection-restricting part; and the return-restricting part and the projection-restricting part are each capable of contacting the casing in opposing directions.

19. An image-forming device comprising:

a housing;

a power supply mounted in the housing and supplying an electrical bias;

a cartridge that is detachably mountable in the housing, the cartridge comprising:

an image-forming component which receives the electrical bias;

a casing that is configured to accommodate the image-forming component, the casing having an opening formed therein;

a terminal member detachably mounted in the opening formed in the casing and exposed outside the casing via the opening to electrically connect the power supply to the image-forming component, the terminal member comprising:

a return-restricting part restricting the terminal member from returning into the casing;

a projection-restricting part that restricts the terminal member from further protruding out of the casing; and a contact part that is positioned outside the casing and that is electrically connected to the power supply; and an image-carrying member carrying a developer image, the image-forming component including a cleaning member that removes matter deposited on the image-carrying member; and a fixing unit that is mounted in the housing and that fixes the developer image transferred onto a recording medium from the image-carrying member, wherein the terminal member is hook-shape having a tip end and a base part;

the return-restricting part is disposed on the tip end of the terminal member, the projection-restricting part is disposed on the base part, and the contact part is disposed between the return-restricting part and the projection-restricting part; and the return-restricting part and the projection-restricting part are each capable of contacting the casing in opposing directions.

20. An image-forming device comprising:

a housing;

a power supply mounted in the housing and supplying an electrical bias;

a cartridge that is detachably mountable in the housing, the cartridge comprising:

an image-forming component which receives the electrical bias;

a casing that is configured to accommodate the image-forming component, the casing having an opening formed therein;

a terminal member detachably mounted in the opening formed in the casing and exposed outside the casing via the opening to electrically connect the power supply to the image-forming component, the terminal member comprising:

a return-restricting part restricting the terminal member from returning into the casing;

a projection-restricting part that restricts the terminal member from further protruding out of the casing; and a contact part that is positioned outside the casing and that is electrically connected to the power supply;

a roller member that receives an electrical transfer bias supplied from the power supply, the casing accommodating the roller member, the casing having another opening formed therein;

an electrode member inserted into the casing from the outer side thereof via the another opening formed in the casing and contacting an end of the roller member in its axial direction to electrically connect the power supply to the roller member; and a photosensitive member that carries an electrostatic latent image on the surface thereof and that receives a developer for developing the electrostatic latent image into a visible image, the roller member including a transfer roller that transfers the visible image formed on the photosensitive member onto a recording medium, the transfer roller being supported in the casing in a loosely fitted state so as to contact the photosensitive member when the cartridge is mounted in the housing and to separate from the photosensitive member when the cartridge is removed from the housing; and a fixing unit that is mounted in the housing and that fixes the visible image transferred onto a recording medium from the photosensitive member, wherein the terminal member is hook-shape having a tip end and a base part;

the return-restricting part is disposed on the tip end of the terminal member, the projection-restricting part is disposed on the base part, and the contact part is disposed between the return-restricting part and the projection-restricting part; and the return-restricting part and the projection-restricting part are each capable of contacting the casing in opposing directions.

21. A cartridge that is detachably mountable in an image-forming device, the image-forming device having a power supply supplying an electrical bias, the cartridge comprising:

a roller member that receives the electrical bias;

a casing that accommodates the roller member and that has an opening formed therein; and an electrode member inserted into the casing from the outer side thereof via the opening formed in the casing and contacting an end of the roller member in its axial direction to electrically connect the power supply to the roller member, wherein the electrode member is located as being aligned with the roller member along an axial direction of the roller member, and the electrode member is supported by the casing in a loosely fitted state.

22. A cartridge according to claim 21, wherein when the cartridge is mounted in the image-forming device, the electrode member contacts a power-feeding member, which is provided in the image-forming device and which is connected to the power supply, and is urged inward in the axial direction of the roller member; and the roller member becomes positioned in the axial direction through pressure from the urging electrode member.

23. A cartridge according to claim 21, wherein the electrode member comprises:

a base part that is urged by the power-feeding member;

an engaging part extending from the base part in a direction toward the roller member along the axial direction of the roller member to engage with the casing; and a contact part that extends from the base part in a direction toward the roller member in the axial direction of the roller member to contact an end surface of the roller member in its axial direction.

24. A cartridge according to claim 23, wherein the contact part comprises a contact surface that contacts the end surface of the roller member at its rotational center; and the engaging part is disposed confronting the contact part, with a gap being formed between the engaging part and the contact part, the engaging part comprising an engaging surface that engages with an inner surface of the casing at a peripheral edge of the opening formed therein.

25. A cartridge according to claim 24, wherein the casing comprises a restricting member that is disposed between the base part of the electrode member and the roller member and that is capable of contacting the end surface of the roller member to restrict movement of the roller member toward the base part.

26. A cartridge according to claim 25, wherein the restricting member comprises a restricting surface opposing the end surface of the roller member, and wherein the electrode member is disposed so that the distance between the engaging surface of the engaging part and the inner surface of the casing in the axial direction of the roller member is greater than the distance between the end surface of the roller member and the restricting surface of the restricting member when the cartridge is mounted in the image-forming device.

27. A cartridge according to claim 21, further comprising a photosensitive member that carries an electrostatic latent image on the surface thereof and that receives a developer for developing the electrostatic latent image into a visible image, wherein the roller member is a transfer roller that transfers the visible image formed on the photosensitive member onto a recording medium, and the transfer roller is supported in the casing in a loosely fitted state so as to contact the photosensitive member when the cartridge is mounted in the image-forming device and to separate from the photosensitive member when the cartridge is removed from the image-forming device.

28. An image-forming device comprising:

a housing;

a power supply mounted in the housing and supplying an electrical bias;

a cartridge that is detachably mountable in the housing, the cartridge comprising:

a roller member that receives the electrical bias;

a casing that accommodates the roller member, the casing having an opening formed therein;

an electrode member inserted into the casing from the outer side thereof via the opening formed in the casing and contacting an end of the roller member in its axial direction to electrically connect the power supply to the roller member; and a photosensitive member that carries an electrostatic latent image on the surface thereof and that receives a developer for developing the electrostatic latent image into a visible image, the roller member including a transfer roller that transfers the visible image formed on the photosensitive member onto a recording medium, the transfer roller being supported in the casing in a loosely fitted state so as to contact the photosensitive member when the cartridge is mounted in the housing and to separate from the photosensitive member when the cartridge is removed from the housing; and a fixing unit that is mounted in the housing and that fixes the visible image transferred onto a recording medium from the photosensitive member, wherein the electrode member is located as being aligned with the roller member along an axial direction of the roller member, and the electrode member is supported by the casing in a loosely fitted state.

* * * * *